US007896459B2

(12) United States Patent
Sano et al.

(10) Patent No.: US 7,896,459 B2
(45) Date of Patent: Mar. 1, 2011

(54) IMAGE RECORDING DEVICE AND METHOD FOR CORRECTING DEFORMATION OF PRINTED SHEET

(75) Inventors: Iwane Sano, Nagoya (JP); Yasuhira Ota, Yatomi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/388,416

(22) Filed: Feb. 18, 2009

(65) Prior Publication Data

US 2009/0218758 A1 Sep. 3, 2009

(30) Foreign Application Priority Data

Feb. 29, 2008 (JP) ..... 2008-051318

(51) Int. Cl.
*B41J 29/38* (2006.01)

(52) U.S. Cl. ..... 347/16; 347/104

(58) Field of Classification Search ..... 347/16
See application file for complete search history.

(56) References Cited

U.S. PATENT DOCUMENTS

| | | | | |
|---|---|---|---|---|
| 5,820,283 | A * | 10/1998 | Sunada et al. | 271/209 |
| 6,634,745 | B2 | 10/2003 | Tanno | |
| 6,712,463 | B2 | 3/2004 | Matsumoto | |
| 7,125,092 | B2 | 10/2006 | Ouchi | |
| 2006/0038870 | A1 | 2/2006 | Nonaka | |
| 2006/0132513 | A1 | 6/2006 | Ozaki et al. | |
| 2007/0070113 | A1 | 3/2007 | Kawabata et al. | |
| 2009/0085949 | A1 * | 4/2009 | Sugiyama et al. | 347/16 |

FOREIGN PATENT DOCUMENTS

| | | | |
|---|---|---|---|
| JP | 01099853 A | * | 4/1989 |
| JP | H07-068871 A | | 3/1995 |
| JP | H07-132658 A | | 5/1995 |
| JP | H08-224864 A | | 9/1996 |
| JP | H08-282034 A | | 10/1996 |

(Continued)

OTHER PUBLICATIONS

European Patent Office, European Search Report in counterpart Patent Application No. EP 09002514 mailed Jul. 15, 2009.

(Continued)

*Primary Examiner* — Matthew Luu
*Assistant Examiner* — Shelby Fidler
(74) *Attorney, Agent, or Firm* — Baker Botts L.L.P.

(57) ABSTRACT

An image recording device comprises a recording unit configured to eject ink onto a sheet of recording medium, a platen disposed opposite to the recording unit and configured to support the sheet, a pair of upstream rollers disposed upstream of the recording unit and the platen in a sheet conveying direction and configured to convey the sheet in the sheet conveying direction when rotating in a forward direction, and a controller. When the sheet is supported on the platen and pinched between the pair of upstream rollers, the controller causes the recording unit to eject the ink onto a particular portion of the sheet. The controller selectively rotates the pair of upstream rollers in a reverse direction to convey the sheet in a direction opposite the sheet conveying direction, and subsequently stops rotating the pair of upstream rollers in a reverse direction, such that the pair of upstream rollers pinch the sheet for a particular amount of time and hold the sheet in a predetermined shape during the particular amount of time to restrict deformation of the particular portion of the sheet.

19 Claims, 17 Drawing Sheets

FOREIGN PATENT DOCUMENTS

| | | | |
|---|---|---|---|
| JP | H09-239972 | A | 9/1997 |
| JP | 2000-218773 | A | 8/2000 |
| JP | 2002-127517 | A | 5/2002 |
| JP | 2003-221151 | A | 8/2003 |
| JP | 2004-237506 | A | 8/2004 |
| JP | 2004-292167 | A | 10/2004 |
| JP | 2005-280214 | A | 10/2005 |
| JP | 2006-082546 | A | 3/2006 |
| JP | 2006-168948 | A | 6/2006 |
| JP | 2007-119112 | A | 5/2007 |

OTHER PUBLICATIONS

Japan Patent Office; Notice of Reasons for Rejection in Japanese Patent Application No. 2008-051318 (counterpart to the above-captioned U.S. patent application) mailed Aug. 20, 2010.

* cited by examiner

Fig.17

| TEMPERATURE RANGE | STOPPING TIME T |
|---|---|
| A | 5 SEC. |
| B | 10 SEC. |
| C | 15 SEC. |
| D | 20 SEC. |
| E | 25 SEC. |

IMAGE RECORDING DEVICE AND METHOD FOR CORRECTING DEFORMATION OF PRINTED SHEET

CROSS-REFERENCE TO RELATED APPLICATION

The present application claims priority from Japanese Patent Application Publication No. JP-2008-051318, which was filed on Feb. 29, 2008, the disclosure of which is incorporated herein by reference in its entirety.

BACKGROUND OF THE INVENTION

1. Field of the Invention

The invention relates to a device and a method for ejecting ink droplets to record an image on a recording medium.

2. Description of Related Art

A known image recording device, e.g., an inkjet printer, records an image on a sheet of recording medium while the sheet is conveyed intermittently. In a known inkjet printer, a sheet is conveyed onto a platen while being pinched between a pair of opposed rollers. After the sheet reaches the platen, the pair of rollers are driven intermittently. Each time the sheet is conveyed by a predetermined sheet feed distance and stopped, a recording head moves in a direction orthogonal to a sheet conveying direction and ejects ink droplets onto the sheet. As sheet feed and ink ejection are repeated, a desired image is formed on the sheet from a leading edge to a trailing edge thereof.

In the known inkjet printer, sheet cockling may occur. Sheet cockling is a phenomenon where ink permeates fibers of the sheet and expands the fibers such that the sheet is curled and undulated. If sheet cockling occurs, a distance between the sheet and the recording head may fluctuate during image recording, and the accuracy in image recording may deteriorate. The deformed sheet may contact the recording head or cause a leading edge of the sheet to deviate from the conveying path and may cause a sheet jam.

A known inkjet printer, e.g., the printer described in Japanese Laid-Open Patent No. 2004-237506, comprises a recording head, a platen opposed to the recording head, a pair of rollers disposed upstream of the platen, and a pair of rollers disposed downstream of the platen. When an amount of ink which causes deformation of a sheet is ejected from the recording head onto the sheet while the sheet is pinched by the upstream rollers, the sheet is conveyed till a leading edge of the sheet is pinched by the downstream rollers. Then, the sheet is held by the upstream rollers and the downstream rollers for a predetermined amount of time to reduce deformation of a leading edge side of the sheet.

In the known inkjet printer, the leading edge of the sheet is pinched by the downstream rollers. However, when the sheet, e.g., a sheet having fibers running widthwise, is prone to suffer from cockling, the leading edge may be deformed greatly before the leading edge reaches the downstream rollers, and the deformed leading edge may collide with the downstream rollers and cause a sheet jam. When the distance between the recording head and the sheet is relatively small, the deformed sheet may contact the recording head and cause deterioration of the recorded image or damage to the sheet.

SUMMARY OF THE INVENTION

Therefore, an object of the invention is to provide an image recording device and method which overcome these and other shortcomings of the related art by restricting and/or correcting deformation of a sheet. Technical advantages of the invention are that sheet jams are reduced by restricting and/or correcting deformation of a sheet, and image quality is improved by maintaining a constant gap between a recording head and a sheet being conveyed.

According to an embodiment of the invention, an image recording device comprises a recording unit configured to eject ink onto a sheet of recording medium, a platen disposed opposite to the recording unit and configured to support the sheet, a pair of upstream rollers disposed upstream of the recording unit and the platen in a sheet conveying direction and configured to convey the sheet in the sheet conveying direction when rotating in a forward direction, and a controller. When the sheet is supported on the platen and pinched between the pair of upstream rollers, the controller is configured to control the recording unit to eject the ink onto a particular portion of the sheet. The controller is configured to selectively rotate the pair of upstream rollers in a reverse direction opposite the forward direction to convey the sheet in a direction opposite the sheet conveying direction, and is configured to subsequently stop rotating the pair of upstream rollers in the reverse direction, such that the pair of upstream rollers pinch the sheet for a particular amount of time. The upstream rollers are configured to hold the sheet in a predetermined shape that restricts deformation of the particular portion of the sheet during the particular amount of time.

According to another embodiment of the invention, a method for conveying a sheet of recording medium in an image recording device, the method comprises rotating a pair of upstream rollers in a forward direction to convey the sheet in a sheet conveying direction, pinching the sheet between the pair of upstream rollers, performing image recording by ejecting ink onto a portion of the sheet, rotating the pair of upstream rollers in reverse to convey the sheet in a direction opposite the sheet conveying direction, stopping the reverse rotation of the pair of upstream rollers such that the pair of upstream rollers pinch the sheet between the pair of upstream rollers for a particular amount of time, and holding the sheet in a predetermined shape to restrict deformation of the portion of the sheet with the pair of upstream rollers.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

FIG. 17 is a table containing a set of stopping times for various temperature ranges according to an embodiment of the invention.

DETAILED DESCRIPTION OF THE EMBODIMENTS

Embodiments of the invention and their features and technical advantages may be understood by referring to FIGS. 1-17, like numerals being used for like corresponding parts in the various drawings.

Figure 1:
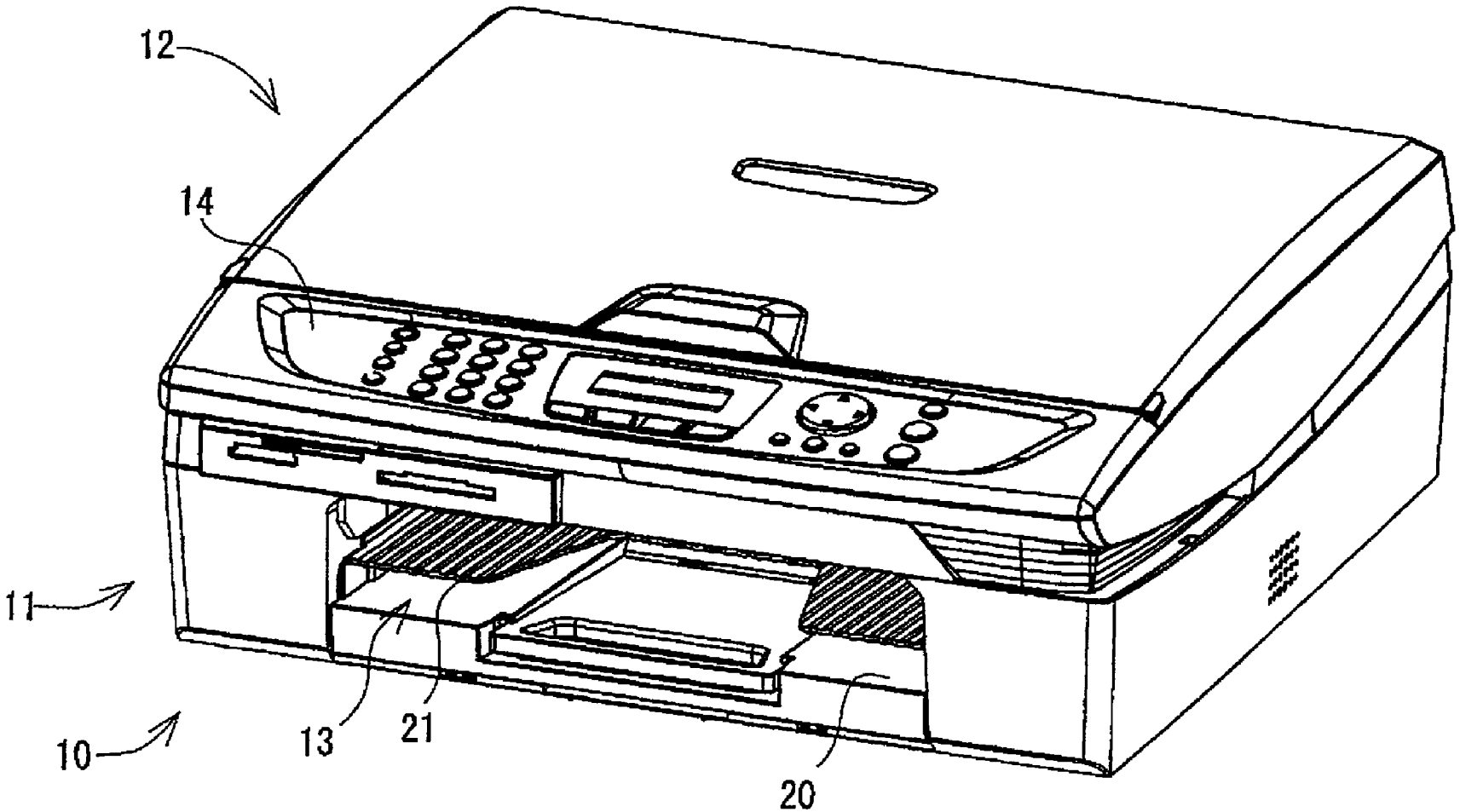
FIG. 1 is a perspective view of an image recording device, e.g., a multi-function device, according to an embodiment of the invention.

Referring to FIG. 1, an image recording device, e.g., a multi-function device 10, may comprise a printer 11 at a lower portion thereof, and a scanner 12 at an upper portion thereof. The multi-function device 10 may perform one or more functions, e.g., printing, copying, scanning, facsimile functions, or any combination thereof.

The printer 11 may be connected to an external device, e.g., a computer, and may be configured to record an image, e.g., text or the like, on a recording medium based on image data transmitted from the external device. The scanner 12 may be a flatbed scanner.

The multi-function device 10 may have a substantially box shape, and may have a width and a depth which are greater than a height of the multi-function device 10. The printer 11 may have an opening 13 at a front of the multi-function device 10. A sheet tray 20 and an output tray 21 may be disposed inside the opening 13. A sheet on the sheet tray 20 is conveyed to the printer 1, and the sheet on which an image has been recorded may be discharged onto the output tray 21.

An operation panel 14 for the printer 11 and the scanner 12 may be disposed at an upper, front portion of the multi-function device 10. The operation panel 14 may comprise operation buttons and a liquid crystal display. The multi-function device 10 may operate based on instructions received via the operation panel 10, or instructions received from a computer connected to the multi-function device 10 via a printer driver or a scanner driver.

Figure 2:
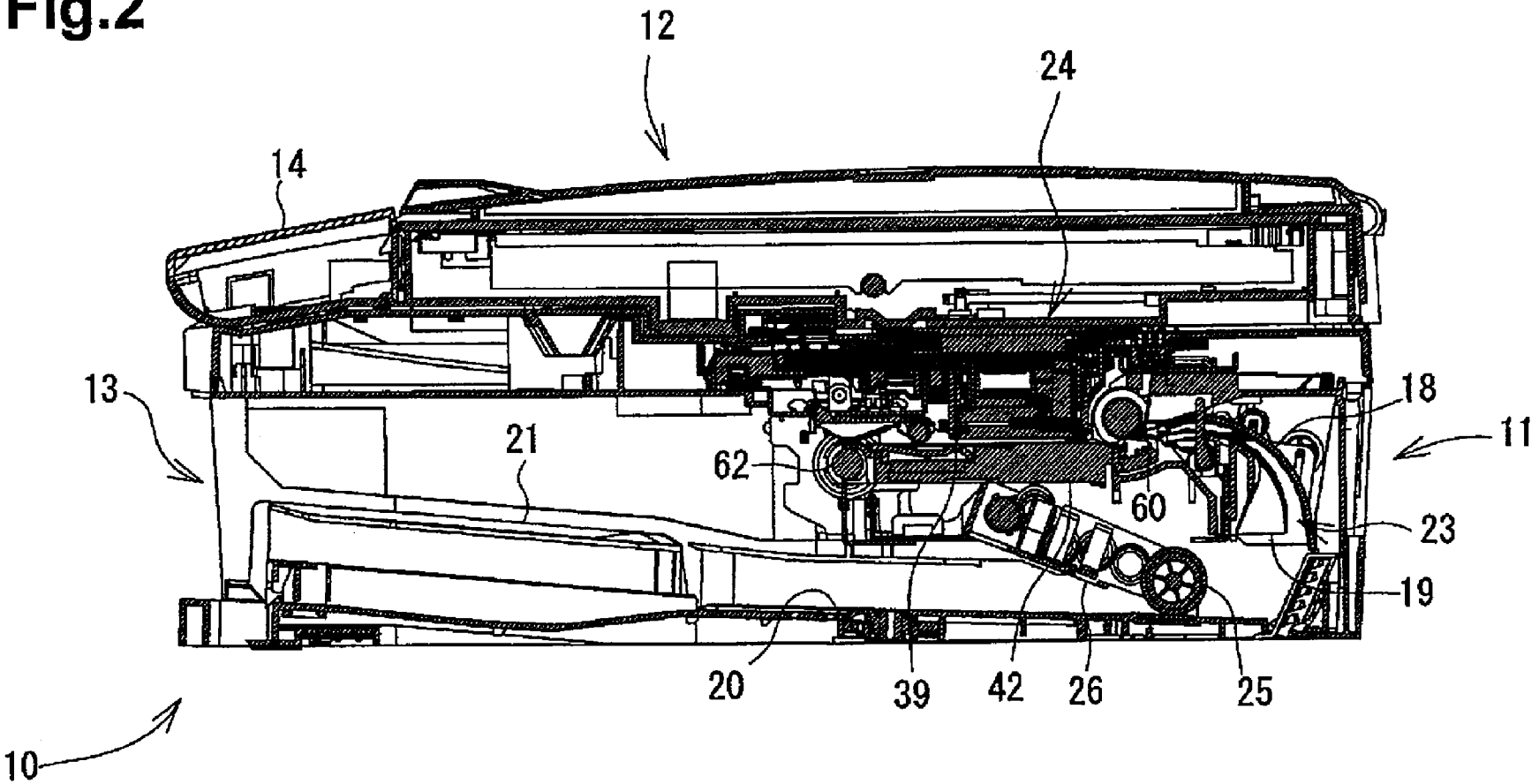
FIG. 2 is a vertical cross-sectional view illustrating an internal structure of the image recording device according to an embodiment of the invention.

Referring to FIG. 2, the sheet tray 20 may be disposed at a bottom portion of the multi-function device 10. The sheet tray 20 may be an upwardly opened container configured to store sheets of paper, e.g., A4 size paper, B5 size paper, postcard size paper, or the like therein. The output tray 21 may be positioned above the sheet tray 20. A conveying path 23 may extend from the sheet tray 20 to the output tray 21. A sheet of recording medium on the sheet tray 20 may be guided upward, turned around along the conveying path 23 to reach a recording unit 24. The recording unit 24 then records an image onto the sheet, and the sheet may be discharged onto the output tray 21.

Figure 6:
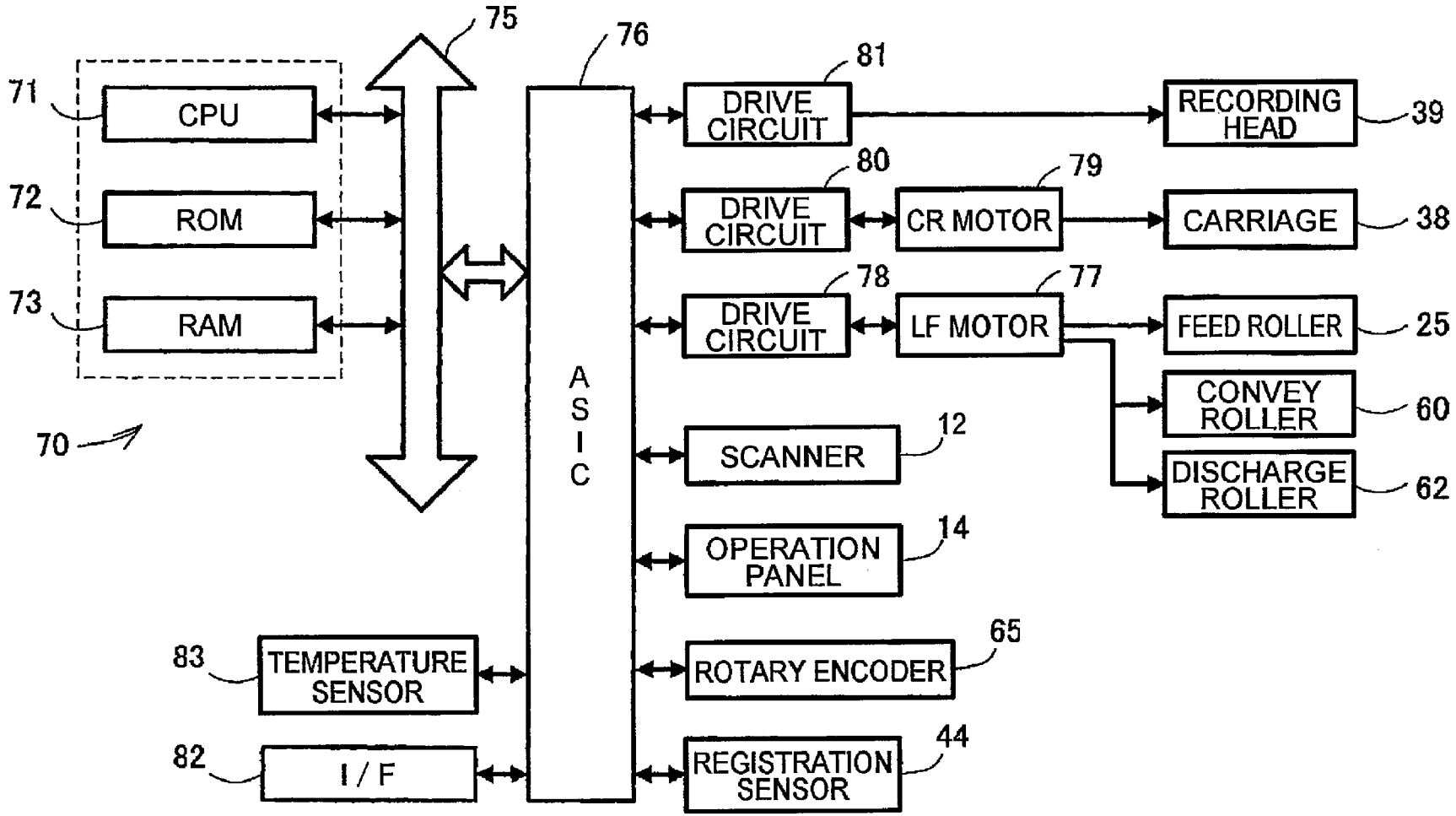
FIG. 6 is a block diagram illustrating a structure of a controller of the image recording device according to an embodiment of the invention.

A feed roller 25 may be disposed at an inner portion of the sheet tray 20. As shown in FIG. 6, the feed roller 25 may be driven by a line feed motor ("LF motor") 77 and may feed a sheet from the sheet tray 20 to the conveying path 23. The feed roller 25 may be rotatably supported at an end of an arm 26. The arm 26 may be configured to pivot about a base end thereof and may selectively move toward and away from the sheet tray 20. The arm 26 may be biased by the weight of the feed roller 25 or by a spring, or by both, and may pivot downward such that the feed roller 25 contacts an uppermost one of the sheets on the sheet tray 20.

The conveying path 23 may extend upward from an inner portion of the sheet tray 20, bend toward the front of the multi-function device 10, pass the recording unit 24, and reach the output tray 21. A bent portion of the conveying path 23 at the inner portion of the sheet tray 20 may be defined by an outer guide member 18 and an inner guide member 19.

Figure 3:
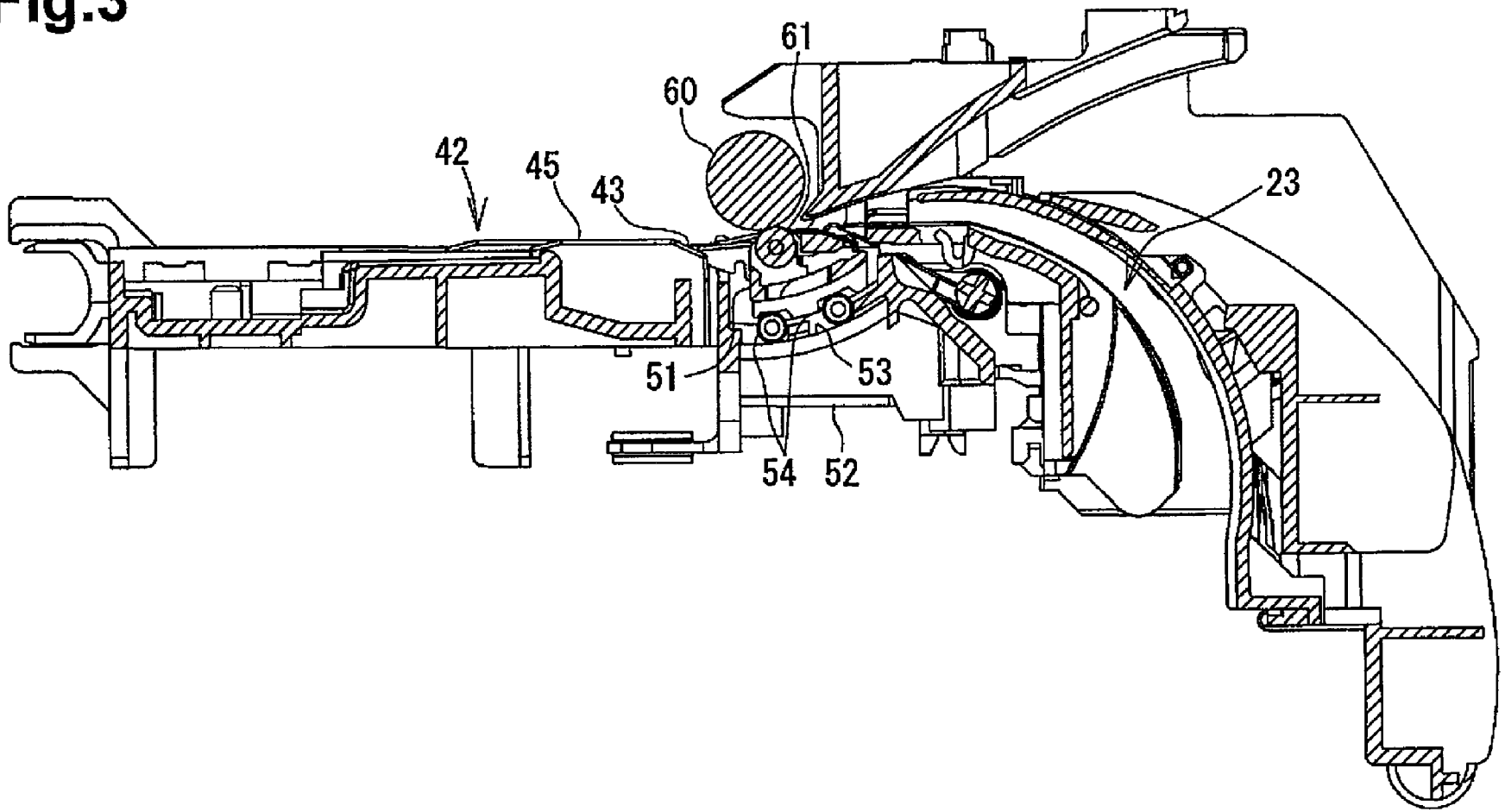
FIG. 3 is a partial cross-sectional view illustrating structures of a pinch roller and its surroundings according to an embodiment of the invention.

Referring to FIGS. 2 and 3, a convey roller 60 and a pinch roller 61 may be disposed upstream of the recording unit 24 in the sheet conveying direction 104. The pinch roller 61 may be disposed on a lower side of the convey roller 60. The convey roller 60 may be driven by the line feed motor 77, as shown in FIG. 6.

Figure 5:
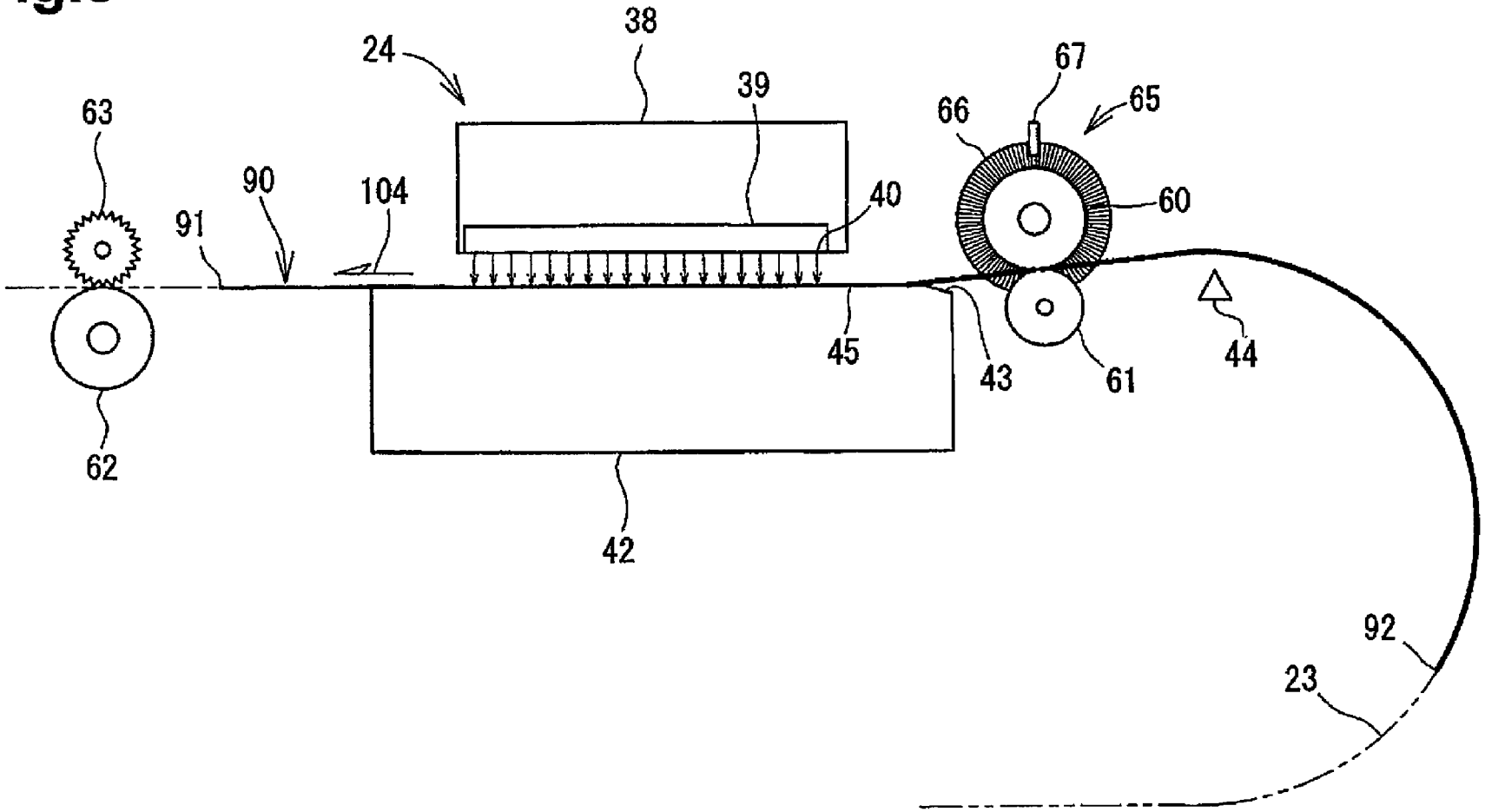
FIG. 5 is a schematic view illustrating structures of a recording unit and its surroundings according to an embodiment of the invention.

Referring to FIG. 5, a rotary encoder 65 may be disposed at the convey roller 60. The rotary encoder 65 may comprise an encoder disk 66, which is coaxial with the convey roller 60 and rotates with the convey roller 60, and an optical sensor 67. Light-passing portions and light-blocking portions may be arranged alternatively at regular intervals in a circumferential direction of the encoder disk 66. The optical sensor 67 may comprise a light emitter and a light receiver which are opposite to each other with the encoder disk 66 disposed therebetween. When the encoder disk 66 rotates with the convey roller 60, light emitted by the light emitter may be blocked by the light blocking portions at regular intervals. The light receiver may generate pulse signals based on the intensity of received light. The amount of rotation of the convey roller 60 is detected based on the pulse signals.

A sheet 90 may be conveyed by the convey roller 60 in a sheet conveying direction 104 while being pinched by the convey roller 60 and the pinch roller 61. The pinch roller 61 may be rotated by the sheet 90, which is being conveyed.

A discharge roller 62 and a spur 63 may be disposed downstream of the recording unit 24 in the sheet conveying direction 104. The spur 63 may be on an upper side of the discharge roller 62. The spur 63 may be urged by an elastic member, e.g., a spring, to contact the discharge roller 62. The discharge roller 62 may be driven by the line feed motor 77, as shown in FIG. 6. The discharge roller 62 and the convey roller 60 may rotate synchronously. The sheet 90 having an image recoded thereon may be discharged onto the output tray 21 while being pinched by the discharge roller 62 and the spur 63.

The convey roller 60 and the discharge roller 62 may be driven intermittently during image recording. The convey roller 60 and the discharge roller 62 may rotate by a rotation amount corresponding to a sheet feed amount F, and may stop after the sheet 90 has been conveyed by the sheet feed amount F. The sheet feed amount F may be a predetermined amount based on the recording resolution of an image. The sheet feed amount F may be smaller for image recording in fine interlaced mode, e.g., high resolution, than for image recording in normal mode, e.g., medium resolution. When the sheet is being fed before image recording or when the sheet is being discharged after image recording, the convey roller 60 and the discharged roller 62 may rotate continuously.

Referring to FIG. 5, a registration sensor 44 may be disposed upstream of the convey roller 60 in the sheet conveying path 23. The registration sensor 44 may detect the sheet 90 passing in the sheet conveying path 23. A detection portion of the sensor 44, which is projecting into the sheet conveying path 23, may retract upon contact with the sheet 90 passing in the sheet conveying path 23. The sensor 44 optically may detect whether the detection portion is projecting or retracted and may output an on/off signal based on the detection result. Whether a leading edge or a trailing edge of the sheet 90 reaches the position of the sensor 44 may be determined based on an on/off signal from the sensor 44.

Referring to FIG. 5, the recording unit 24 may comprise a carriage 38, recording head 39 and a platen 42. The carriage 38 and the platen 42 may be disposed between the convey roller 60 and the discharge roller 62, and may be opposite to each other vertically with the sheet conveying path 23 positioned therebetween. The carriage 38 may comprise the recording head 39. The carriage may be driven by a carriage motor, e.g., CR motor 79, as shown in FIG. 6, to travel back and forward horizontally in a direction orthogonal to the sheet conveying direction 104. Cyan, magenta, yellow, and black inks may be supplied from ink cartridges (not shown) to the recording head 34 through ink tubes (not shown). The ink cartridges may be disposed separately from the recording head 39.

The platen 42 may be disposed on a lower side of the sheet conveying path 23 and may extend along a sheet passing zone which is within the traveling range of the carriage 38. The platen 42 may be wide enough to accommodate a width of a sheet of maximum size in the printer 11. A distance between the recording head 39 and the sheet 90 supported on an upper surface 45 of the platen 42 may be maintained at a predetermined distance.

A guide surface 43 may be formed at an upstream end of the platen 42 in the sheet conveying direction 104. The guide surface 43 may incline downward from the upper surface 45 of the platen 42 to an upstream end of the guide surface 43. The guide surface 43 may comprise a rib projecting from the platen 42 toward the upstream side.

The guide surface 43 may guide a leading edge of the sheet 90 toward the upper surface 45 of the platen 42. The carriage 38 may move in a direction orthogonal to the sheet conveying direction 104 when the convey roller 60 and the discharge roller 62 are stopped. When the carriage 38 is moving, droplets of ink of various colors selectively may be ejected from nozzles of the recording head 39 and reach the sheet 90 which is held stationary on the platen 42.

Referring to FIG. 3, the pinch roller 61 may be rotatably supported by a pinch roller holder 51. The pinch roller holder 51 may support the pinch roller 61 such that a shaft of the pinch roller 61 may selectively move toward and away from the convey roller 60. The pinch roller holder 51 may comprise a spring (not shown) that urges the shaft of the pinch roller 61 toward the convey roller 60 such that the pinch roller 61 is pressed against the convey roller 60. When the sheet 90 travels between the convey roller 60 and the pinch roller 61, the shaft of the pinch roller 61 may move away from the convey roller 60. With the pinch roller 61 urged by the spring toward the convey roller 60, a rotating force of the convey roller 60 may be applied to the sheet 90.

The pinch roller holder 51 may be supported by a holder base 52 so as to move along the sheet conveying direction 104. The holder base 52 may comprise an upper surface 53, which is a circumferential surface substantially about the shaft of the convey roller 60. The pinch roller holder 51 may be supported on the upper surface 53 via two cylindrical rollers 54 such that the pinch roller holder 61 is movable along the upper surface 53.

Figure 4A:
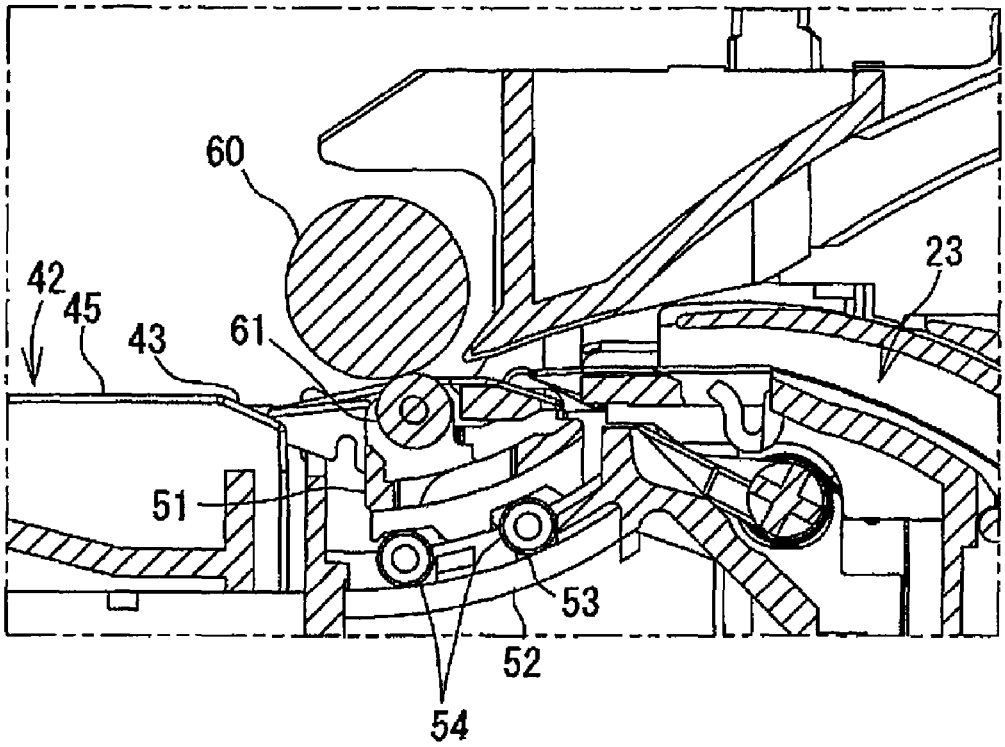
FIG. 4A is an enlarged cross-sectional view of a pinch roller holder located at a retracted position according to an embodiment of the invention.
Figure 4B:
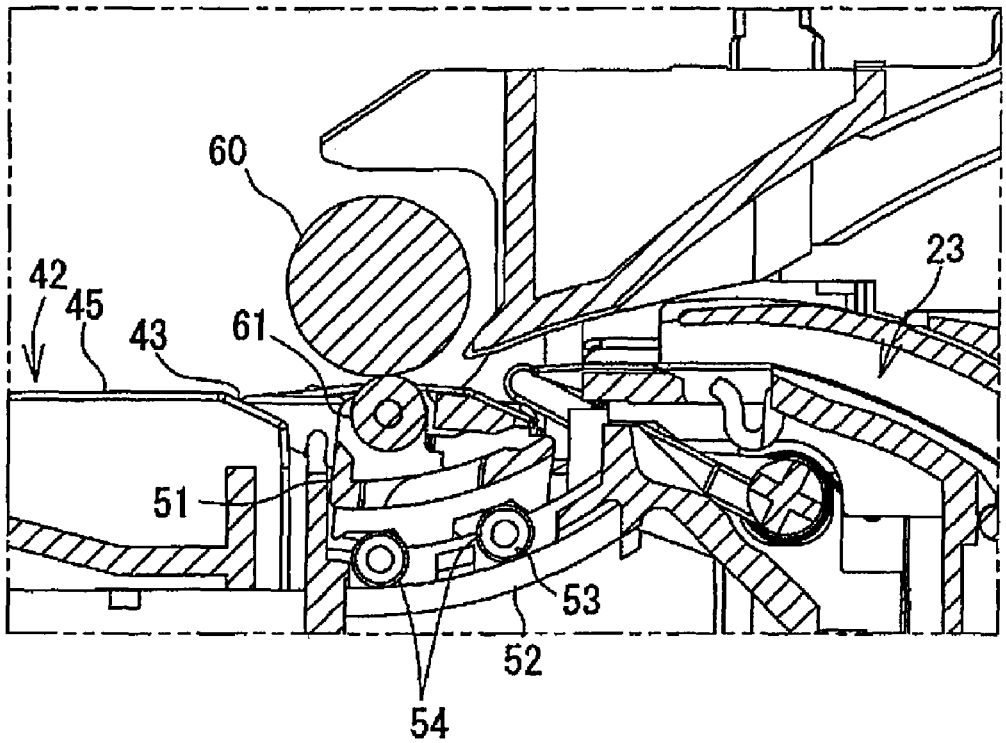
FIG. 4B is an enlarged cross-sectional view of the pinch roller holder located at an advanced position according to an embodiment of the invention.

As shown in FIG. 4A, when there is no sheet between the convey roller 60 and the pinch roller 61, the pinch roller holder 51 may be at a retracted position which is furthest from the platen 42. As shown in FIG. 4B, as the sheet 90 may travel between the convey roller 60 and the pinch roller 61 in the sheet conveying direction, the pinch roller 61 may move from the retracted position to an advanced position which is closest to the platen 42. After a trailing edge of the sheet 90 passes the convey roller 60 and the pinch roller 61, the pinch roller holder 51 may move from the advanced position to the retracted position.

The sheet 90 pinched by the convey roller 60 and the pinch roller 61 may slant downwardly as sheet 90 is conveyed onto the platen 42, that is sheet 90 may be conveyed from a higher position than the position of the platen, such that the sheet 90 is pressed against the platen 42. The convey roller 60 and the pinch roller 61 may be positioned such that a nip portion therebetween is higher than the upper surface 45 of the platen 42. Referring to FIG. 6, the controller 70 may control the printer 11, the scanner 12 or both. The controller 70 may comprise a CPU ("central processing unit") 72, a ROM ("read only memory") 72, and a RAM ("random access memory") 73. The controller 70 may be connected to one or more sensors, scanner 12, operation panel 14, and others, via a bus 75 and an ASIC ("application specific integrated circuit") 76, such that data may be transmitted between components.

The ROM 72 may store programs for controlling operations of the multi-function device 10. Using one or more of the programs stored in the ROM 72, the controller 70 may control the printer 11 such that the sheet 90 having an image thereon may selectively be conveyed in reverse and stopped for a particular amount of time, e.g., a predetermined time. The ROM 72 may store a threshold value, e.g., an amount of ink ejected from the recording head 39, which is a criteria for determining whether to convey the sheet 90 in reverse. The ROM 72 may store a lookup table for setting the stopping time T for which the sheet 90 is stopped. The stopping time T may be set stepwise depending on a predetermined condition, e.g., a temperature in the printer 11. As shown in FIG. 17, the stopping time T may be set variably for temperature ranges A-E.

The RAM 73 may be a memory area or a work area in which various data used by the CPU 71 to execute the programs stored in the ROM 72 is temporarily recorded. The ASIC 76 may generate a phase signal for energizing the line feed motor 77 in response to a command from the CPU 71.

The ASIC 76 may apply the phase signal to a drive circuit 78 of the line feed motor 77. The controller 70 may control the rotation of the line feed motor 77 by a drive signal applied to the line feed motor 77 via the drive circuit 78.

The drive circuit 78 may be used to drive the line feed motor 77 connected to the feed roller 25, the convey roller 60, and the discharge roller 62. The drive circuit 78 may generate an electrical signal for rotating the line feed motor 77 based on an output signal from the ASIC 76. The rotation of the line feed motor 77 may be transmitted to the feed roller 25, the convey roller 60, and the discharge roller 62 via a drive mechanism comprising a gear and a drive shaft.

The ASIC 76 also may generate a phase signal for energizing the carriage motor 79 in response to a command from the CPU 71, and may apply the phase signal to a drive circuit 80 of the line feed motor 79. The controller 70 may control rotation of the carriage motor 79 by a drive signal applied to the carriage motor 79 via the drive circuit 80. The drive circuit 80 may drive the carriage motor 79 coupled to the carriage 38. The drive circuit 80 may generate an electrical signal for rotating the carriage motor 79 based on an output signal from the ASIC 76. The rotation of the carriage motor 79 may be transmitted to the carriage 38 via a belt driving mechanism to move the carriage 38.

The drive circuit 81 may drive the recording head 39 to eject ink of various colors onto the sheet 90 at predetermined timings. The ASIC 76 may generate an output signal for driving the recording head 39 based on a command from the CPU 71. The controller 70 may calculate, via the drive circuit 81, the amount of ink droplets ejected from the nozzles of the recording head 39.

The registration sensor 44 may be connected to the ASIC 76. Detection signals of the registration sensor 44 may be stored in the RAM 63 via the ASIC 76 and the bus 75. The CPU 71 may analyze the detection signals based on a program stored in the ROM 72, and may determine the positions of a leading edge 91, or a trailing edge 92, or both, of the sheet 90. The CPU 71 may determine the positions of the sheet 90 based on the timings at which the registration sensor 44 detects the leading edge 91, or the trailing edge 92, or both and the sheet feed amount of the convey roller 60.

Figure 7:
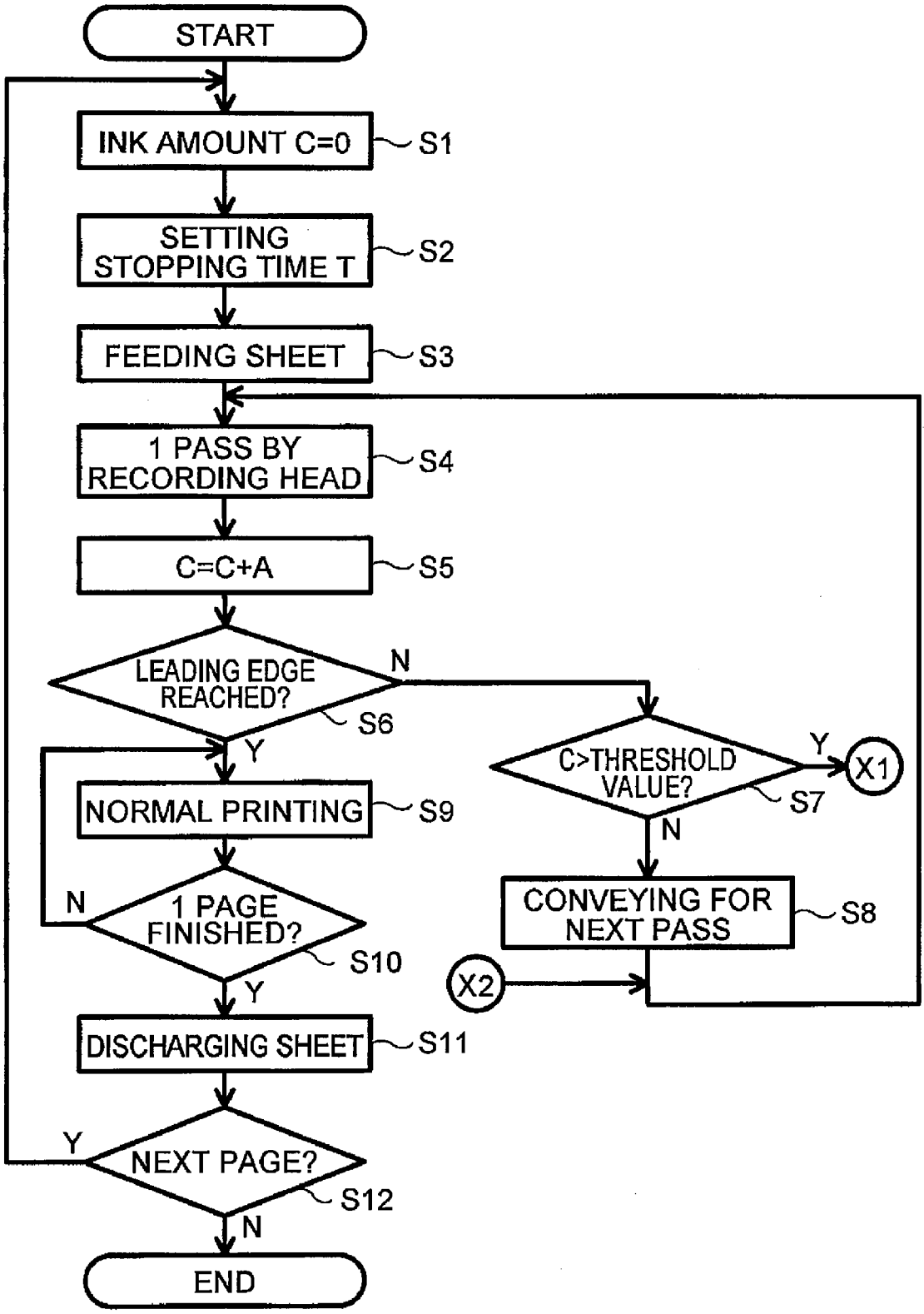
FIG. 7 is a flowchart illustrating an image recording method employed by a printer of the image recording device according to an embodiment of the invention.
Figure 8:
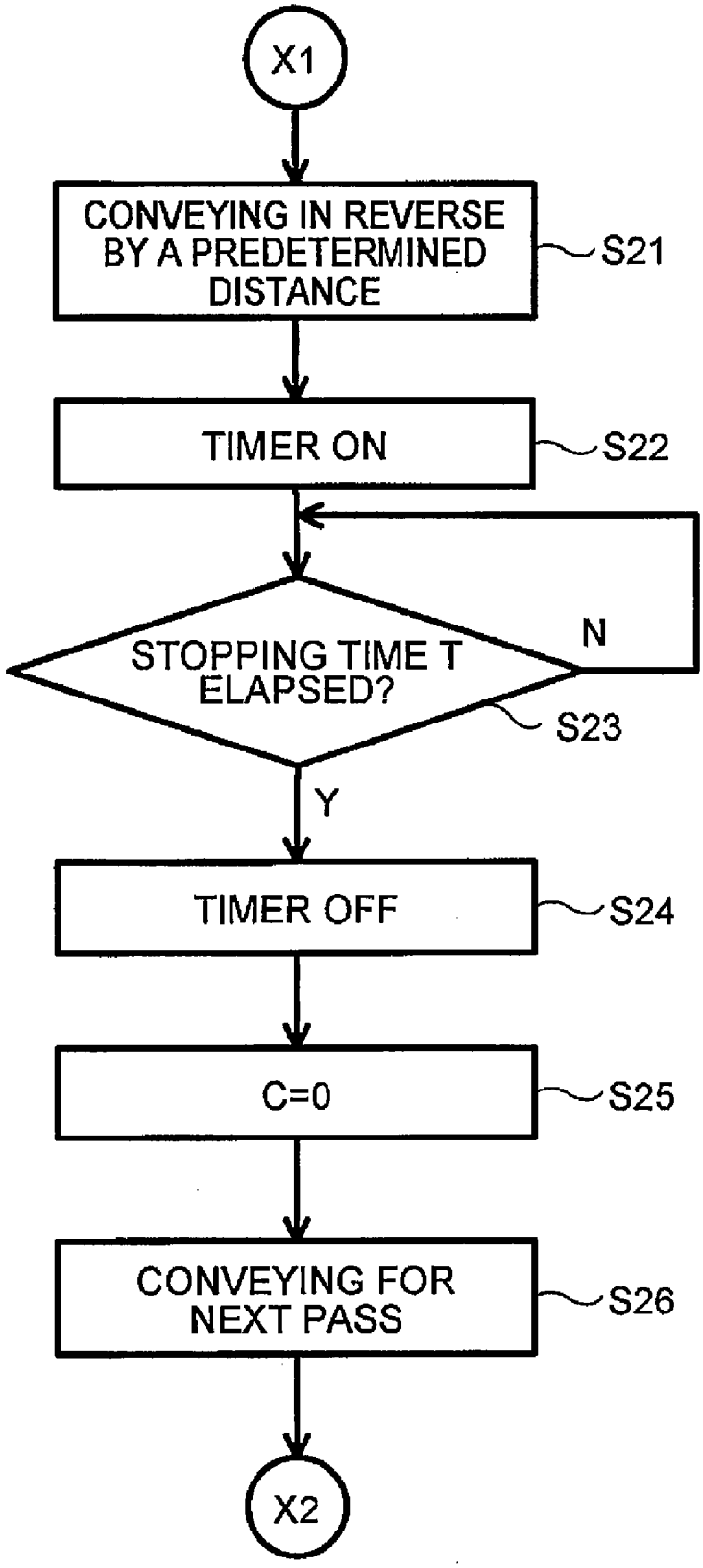
FIG. 8 is a flowchart illustrating an image recording method employed by a printer of the image recording device according to the embodiment of the invention.

The operation panel 14 may be connected to the ASIC 76. Instructions for operating the printer 11 and various settings for printing, e.g., sheet type, sheet size, recording resolution, margins of sheet, printing with/without margin, may be stored as setting information in the RAM 73 via the ASIC 76 and the bus 75. An interface ("I/F") 82 may be connected to the ASIC 76. The controller 70 may transmit data to and receive data from an external device, e.g., a computer, in which a printer driver is installed, via the interface 82. The various settings for printing may be entered either from the operation panel 14 or the printer driver. A temperature sensor 83 may be connected to the ASIC 76. The temperature sensor 83 may be disposed in the printer 11 and may measure the temperature in the printer 11. The controller 70 may determine the temperature in the printer 11 based on an output signal from the temperature sensor 83. Referring to FIG. 7, a user may enter various settings for printing, e.g., the sheet type, sheet size, recording resolution, margins of sheet, at the operation panel 14 or the external device before entering an instruction for staring printing. The setting information may be stored in the RAM 73 or in a RAM of the external device. The sheet type may be set by selecting the applicable items displayed on the operation panel 14 according to the sheets 90 staked on the sheet tray 20. For example, A3, A4, or B5 may be set as the sheet size, and 600 dpi ("dots per inch"), 1200 dpi, or 2400 dpi may be set as the printing resolution. The margins for the leading edge, trailing edge, and side edges of the sheet 90 may be set in units of millimeters.

When the user enters an instruction to start printing at the operation panel 14 or the external device, the controller 70 may receive print data. When the multi-function device 10 performs a copy function, the print data may be generated based on image data scanned by the scanner 12. When the multi-function device 10 performs printing image data prepared by application software in the external device, print data may be transmitted to the multi-function device 10 via the printer driver of the external device.

Upon receiving print data, the controller 70 may initialize the ink amount C stored in the RAM 73 to zero, as shown in step S1 in FIG. 7. In step S2, the controller 70 may set the stopping time T for correcting deformation of the sheet 90 according to a predetermined condition, e.g., the temperature in the printer 11. In an embodiment of the invention, the controller 70 may calculate the temperature in the printer 11 based on a detection signal of the temperature sensor 83, determine which of the temperature ranges A-E the calculated temperature belongs to, and set the stopping time T corresponding to the applicable temperature range.

In step S3, sheet feeding may start. The line feed motor 77 may rotate the feed roller 25, and an uppermost one of the sheets on the sheet tray 20 may be fed into the sheet conveying path 23. The sheet 90 may be conveyed along the sheet conveying path 90 in the conveying direction 104, and the leading edge 91 of the sheet 90 may reach the registration sensor 44. When the registration sensor 44 detects the leading edge 91 of the sheet 90, the signal outputted from the registration sensor 44 may change, e.g., from off to on. When a particular amount of time, e.g., a predetermined time, has elapsed after the change of the signal, the leading edge 91 may reach the nip portion between the convey roller 60 and the pinch roller 61. The controller 70 may determine whether the leading edge 91 has reached the nip portion based on the signal of the registration sensor 44 and the elapsed time.

When leading edge 91 reaches the nip portion, the convey roller 60 may not rotate. Thus, the leading edge 91 may push against an outer surface of the convey roller 60. As such, the leading edge 91 may be aligned against the outer surface of the convey roller 60. Subsequently, when the controller 70 rotates the convey roller 60, the leading edge 91 may be pinched between the convey roller 60 and the pinch roller 61, and the pinch roller holder 51 may move toward the advanced position.

Figure 11:
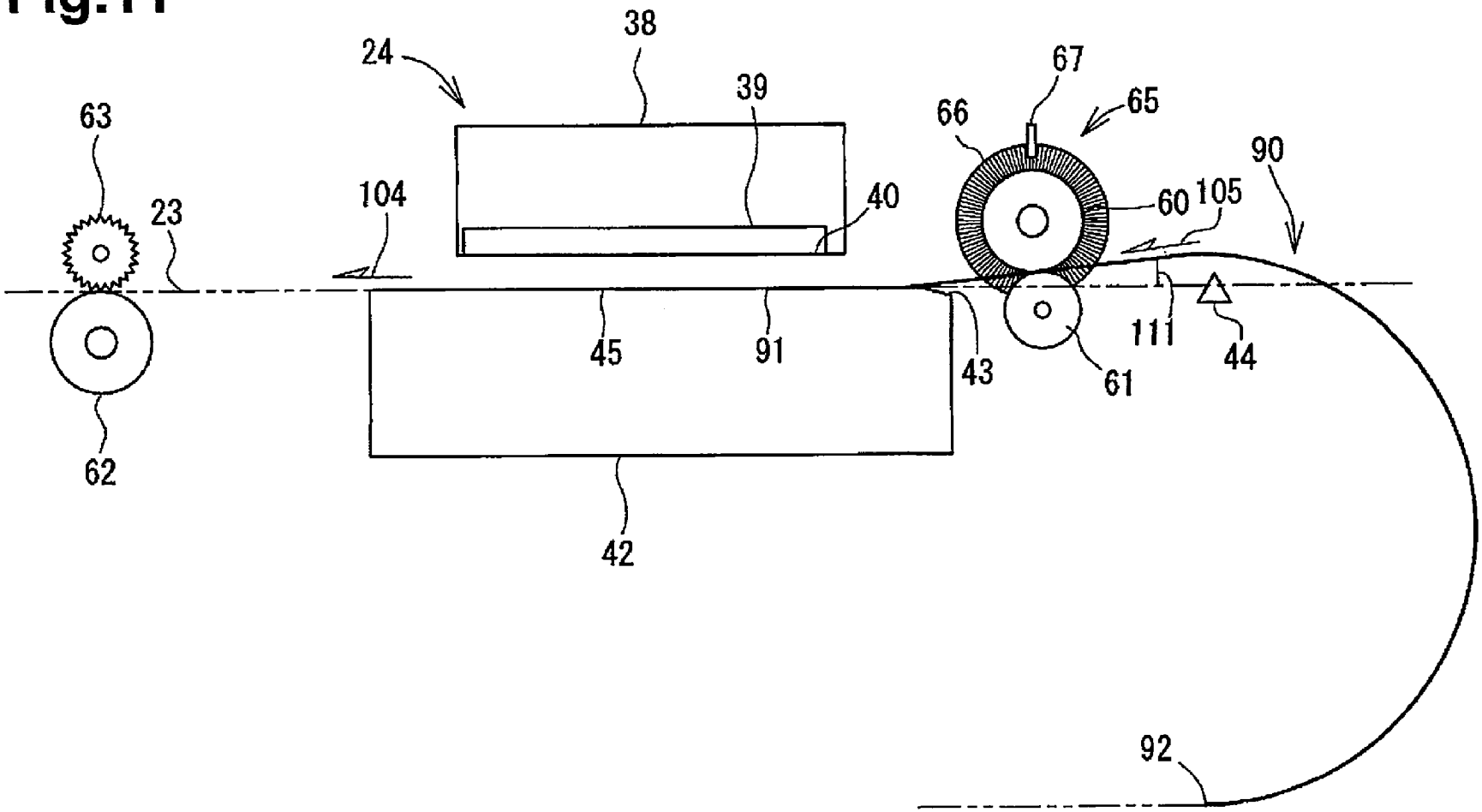
FIG. 11 is a schematic illustrating a printer in which a leading edge of a sheet is at a recording start position on a platen according to an embodiment of the invention.

After convey roller 60 starts rotating, the controller 70 may calculate the rotation amount of the convey roller 60 based on the pulse signals from the rotary encoder 6 to determine the position of the leading edge 91. The controller 70 may rotate the convey roller 60 to convey the sheet 90 by a predetermined amount, and may stop rotating the convey roller when the sheet 90 reaches a print starting position. As shown in FIG. 11, the print starting position may be a position in which the leading edge 91 of the sheet 90 is positioned below a first nozzle 40 of the recording head 39.

As shown in FIG. 11, when the sheet 90 is conveyed by the convey roller 60 and the pinch roller 61, the sheet 90 may be pressed against the upper surface 45 of the platen 42, and the pinch roller holder 51 may be positioned at the advanced position and the pinch roller 61 may be positioned closest to the platen 42. When the pinch roller holder 51 is at the retracted position, the pinch roller 61 may be positioned upstream of the lowest surface point of the convey roller 60. Thus, as the pinch roller 61 moves along the outer surface of the convey roller 60 toward the platen 42, the pinch roller 61 may move downward. As such, the sheet 90 conveyed by the convey roller 60 and the pinch roller 61 in a direction 105 may form a first angle 111 with respect to the upper surface 45 of the platen 42.

When the sheet 90 is at the printing start position, the controller may drive the carriage motor 79 to move the carriage 38 in a direction orthogonal to the sheet conveying direction 104 and may cause the recording head 39 to eject ink droplets onto the sheet 90 based on the print data. In step S4, an image may begin to be recorded from the printing start position of the sheet 90, as shown in FIG. 7. When the carriage 38 moves in a direction orthogonal to the sheet conveying direction 104, a recording head 39 may move and pass across the sheet 90 and may eject ink droplets onto the sheet 90.

In step S5, each time the recording head 39 passes across the sheet 90, the controller 70 may add an amount of ink A ejected from the recording head 39 during each pass to the ink amount C stored in the RAM 73.

In step S6, the controller 70 may determine whether the leading edge 91 of the sheet 90 has reached the nip portion between the discharge roller 62 and the spur 63 based on the on/off signals from the registration sensor 44 and pulse signals from the rotary encoder 65. If the controller 70 determines that the leading edge 91 has not reached the nip portion, the controller 70 may determine whether the ink amount C stored in the RAM 73 has exceeded the threshold value in step S7. The threshold value may correspond to an ink amount which causes the sheet 90 to deform beyond a permissible degree.

If the controller 70 determines that the ink amount C is not greater than the threshold value in step S7, the controller 70 may rotate the convey roller 60 in step S8 to feed the sheet 90 for a distance of the predetermined sheet feed amount F for image recording for the next pass.

After another pass of the recording head 39 in step S4, the controller 70 may add another amount of ink A ejected during the another pass to the ink amount C stored in the RAM 73 in step S5. Subsequently, the controller 70 may determine whether the leading edge 91 of the sheet 90 has reached the nip portion between the discharge roller 62 and the spur 63 in step S6. Steps S4 through S8 may be repeated until the leading edge 91 reaches the nip portion between discharge roller 62 and spur 63.

After the controller 70 determines that the leading edge 91 has reached the nip portion, non-reversing printing may begin in step S9, non-reversing printing is a printing process without a determination by the controller whether the ink amount C exceeds the threshold value.

Non-reversing printing may continue until the printing process for one page is finished. After printing for one page is finished in step S10, the sheet 90 may be discharged onto the output tray 21 in step S11. If the print data includes data for another page in step S12, the controller may reset the ink amount C to zero in step S1, set the stopping time T based on the temperature in the printer 11 in step S2, and cause the printer 11 to perform printing for another page. If the print data does not include data for another page in step S12, the controller 70 may stop the printer from printing.

Figure 12:
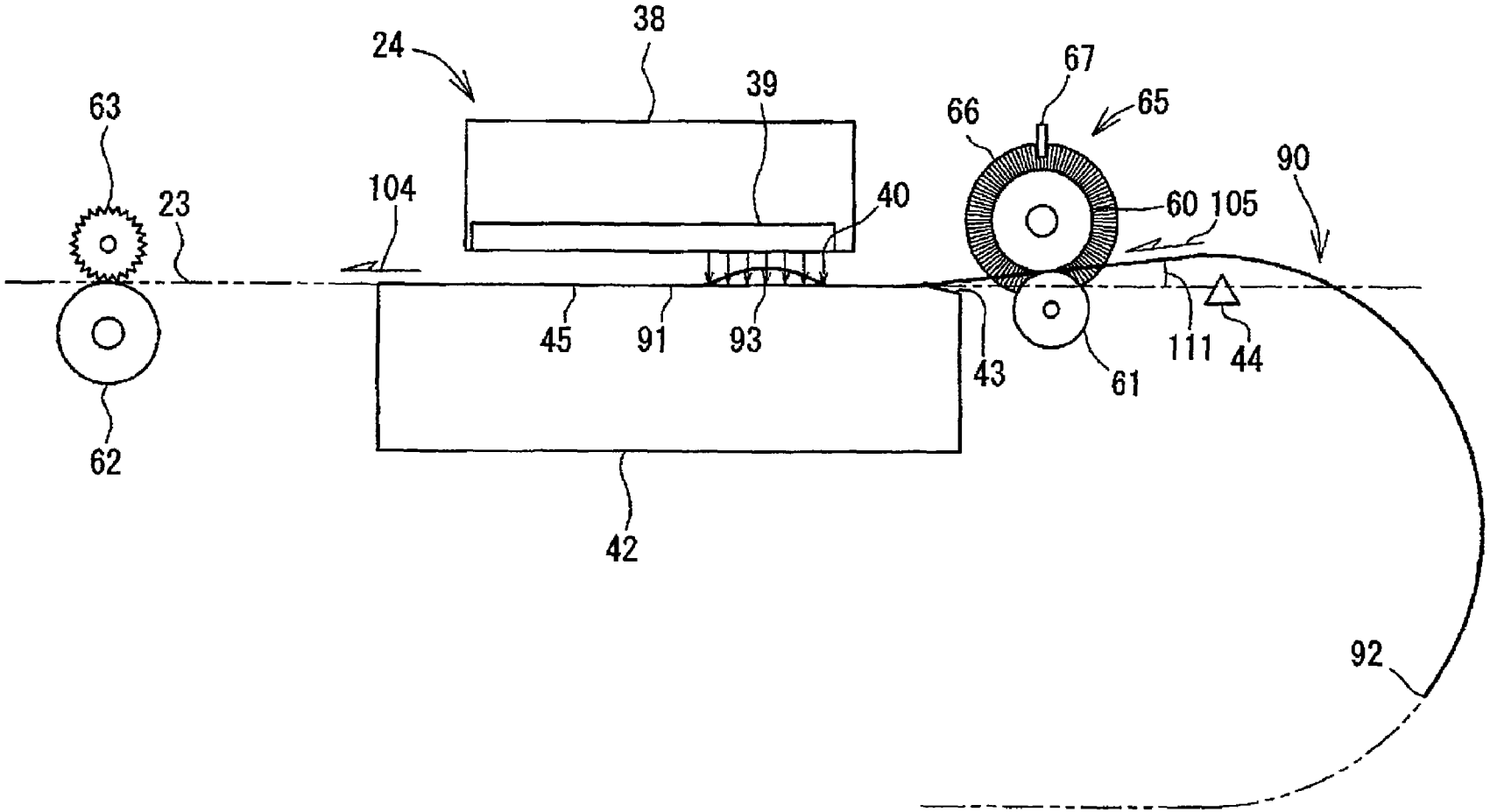
FIG. 12 is a schematic illustrating a printer in which an amount of ink exceeding a threshold value is ejected onto the sheet.

Deformation may occur in the sheet 90 due to absorption of ink. For example, as shown in FIG. 12, a portion 93 of the sheet 90 which receives ink may bow and protrude toward the recording head 39. The degree of such deformation may generally depend on the amount of ink C received by the portion 93 of the sheet 90.

Figure 13:
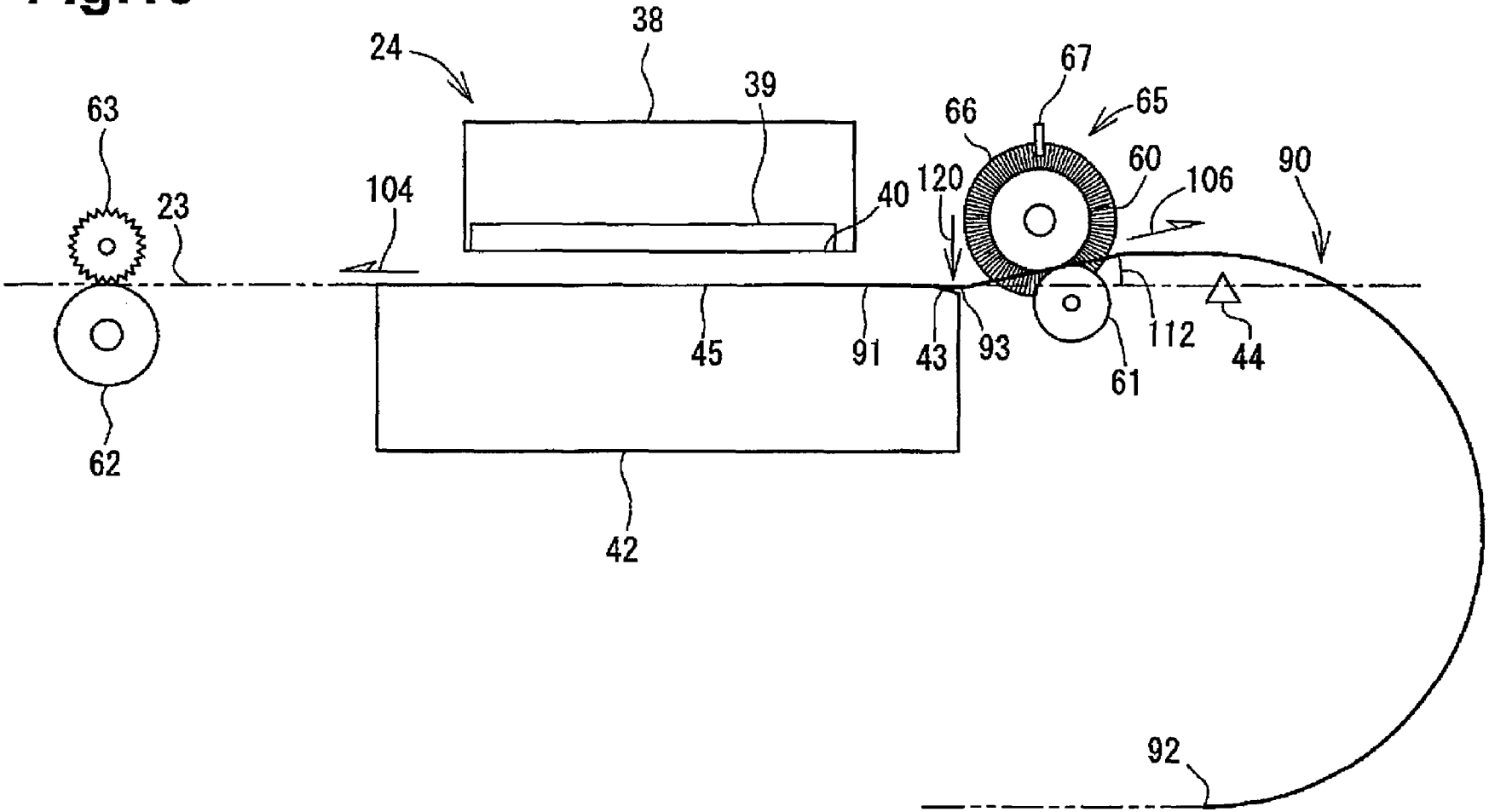
FIG. 13 is a schematic illustrating a printer in which a sheet is held in a predetermined shape according to an embodiment of the invention.

If the ink amount C exceeds the threshold value in step S7 after the recording head 39 makes a pass, the controller 70 may rotate the convey roller 60 in reverse to convey the sheet 90 in reverse, e.g., against the sheet conveying direction 104, by a predetermined distance in step S21. When the sheet 90 is conveyed in reverse, the pinch roller holder 51 may move from the advanced position to the retracted position. The sheet 90 may be conveyed in reverse within a distance such that the portion 93 of the sheet 90 does not reach the nip portion between the convey roller 60 and the pinch roller 61. As shown in FIG. 13, the sheet 90 may be conveyed in reverse until the portion 93 is in the vicinity of the guide surface 43 of the platen 42.

When the portion 93 reaches a vicinity of the guide surface 43, the controller 70 may stop rotating the convey roller 60. The sheet 90 being conveyed in reverse in a direction 106 while being pinched by the convey roller 60 and the pinch roller 61 may form a second angle 112 with respect to the upper surface 45 of the platen 42. As the pinch roller holder 51 moves from the advanced position toward the retracted position, the pinch roller 61 may move upward along the surface of the convey roller 60, and the nip portion between the convey roller 60 and the pinch roller 61 may move upward. Thus, the inclination of the direction 106 with respect to the upper surface 45, e.g., the second angle 112, may become greater than the first angle 111.

After being conveyed in reverse, the sheet 90 may be bent into a predetermined shape in which the portion 93 bows and protrudes toward the platen 42. The portion 93, which was deformed by sheet cockling and was protruding upward may now bow and protrude downward. A correcting downward force 120 may be applied to the portion 93, and the deformation of the portion 93 may be restricted and/or corrected.

When the controller 70 stops rotating the convey roller 60, the controller 70 may start a timer in step S22. When the controller 70 determines that the stopping time counted by the timer exceeds the stopping time T in step S23, the controller 70 may stop the timer in step S24 and may reset the ink amount C stored in the RAM 73 to zero in step S25.

Subsequently, the controller 70 may start rotating the convey roller 60 in a forward direction to convey the sheet 90 in the sheet conveying direction 104 in step S26. As such, the sheet 90 may be conveyed forward by a distance of the sheet feed amount F plus a distance which the sheet 90 was conveyed in reverse. Thus, image recording may be performed on the sheet 90 by the recording head 39 during the next pass. When the sheet 90 is conveyed in the sheet conveying direction 104, the pinch roller holder 51 may move from the retracted position to the advanced position.

When the sheet 90 reaches an image recording position for the next pass, the controller 70 may stop rotating the convey roller 60 and execute image recording for the next pass in step S4. When printing for the next pass by the recording head 39 is finished, the controller 70 may add an ink amount A ejected from the recording head 39 during the pass to the ink amount C stored in the RAM 73 in step S5. Because the ink amount C has been reset to zero in step S25, the ink amount A is stored as the ink amount C in the RAM 73. As shown in FIG. 7, step S8 and step S4 are repeated until the controller 70 determines that the leading edge 91 of the sheet 90 has reached the nip portion between the discharge roller 62 and the spur 63 or unless the ink amount C exceeds the threshold value. If the ink amount C exceeds the threshold value before the leading edge 91 reaches the nip portion between the discharge roller 62 and the spur 63, the sheet 90 may be conveyed in reverse in steps S21 through S26 to invert a deformed portion 93.

According to an embodiment of the invention, the sheet 90 having an image recorded thereon is conveyed in reverse such that the deformed portion 93 which protrudes toward the recording head 39 may be bent to protrude toward the platen 42. This may restrict and correct the deformation of the sheet 90. Accordingly, sheet jams due to deformation of the sheet 90 may be reduced, and the deformed portion 93 may be prevented from contacting the recording head 39 and from being stained by the recording head 39. Image recording quality may be improved because a constant distance between the sheet 90 and the recording head 39 may be maintained.

The controller 70 may set the stopping time T, for which the sheet 90 is stopped, based on predetermined conditions, e.g., the temperature in the printer 11. Accordingly, the deformed portion 93 of the sheet 90 may be corrected efficiently, and printing may be performed quickly.

The sheet 90 may be conveyed by the convey roller 60 and the pinch roller 61 onto the platen 42 in the conveying direction 105, which forms the first angle 111 with respect to the upper surface 45 of the platen 42. The sheet 90 may be held by the convey roller 60 and the pinch roller 61 in the reverse conveying direction 106, which forms the second angle with respect to the upper surface 45. The first angle 111 may be an angle which allows the sheet 90 to contact the upper surface 45, and the second angle 112 may be an angle which allows the deformed sheet 90 to be corrected. The deformation of the sheet 90 may be corrected effectively by setting the second angle 112 greater than the first angle 111.

In an embodiment, the first angle 111 and the second angle 112 may be defined by the pinch roller 61 which moves with the pinch roller holder 51. In another embodiment, the first angle 111 and the second angle 112 may be defined by the pinch roller 61 whose shaft is moved by a motor, or may be defined by the convey roller 81 and the pinch roller 61, which both may be movable.

In an embodiment, the controller 70 may calculate the ink amount C and convey the sheet 90 in reverse when the controller 70 determines that a predetermined condition relating to the ink amount C is satisfied, e.g., when the controller 70 determines that the ink amount C exceeds the threshold value. In another embodiment, the controller 70 may measure a printing time taken by the recording head 39 and convey the sheet 90 in reverse when the controller 70 determines that the printing time exceeds a threshold value. This is because as the printing time increases, the ink amount ejected from the recording head 39 also may increase.

In another embodiment, the controller 70 may count the number of passes made by the recording head 39 for ejecting ink onto the sheet 90 and convey the sheet 90 in reverse when the controller 70 determines that the number of passes exceeds a threshold value. This is because as the number of passes increases, the ink amount ejected from the recording head 39 also may increase.

In another embodiment, the stopping time T may be set based on other conditions which influence the degree of deformation of the sheet 90, e.g., a humidity, an ink amount ejected from the recording head 39, a number of passes made by the recording head 39, a time elapsed from the start of printing, and a type of sheet.

In an embodiment, correction of the portion 93 of the sheet 90 may be performed based on the type of the sheet 90. For example, a sheet having fibers running widthwise may be more likely to be deformed than a sheet having fibers running lengthwise. Correction may be performed for the former and may not be performed for the latter. In another embodiment, the stopping time T may vary based on the type of sheet used. Further, the threshold value, e.g., the ink amount C, which may be used as a criteria to determine whether to convey the sheet 90 in reverse, may vary based on the type of sheet used.

As shown in FIG. 7, a printing process with a determination by the controller 70 whether the ink amount C exceeds the threshold value may be stopped when the leading edge 91 of the sheet 90 has reached the nip portion between the discharge roller 62 and the spur 63 because a sheet jam is unlikely to occur once the leading edge 91 reaches the nip portion. In another embodiment, a contact member, e.g., a spur, may be disposed downstream of the recording unit 24 and the platen 42 and upstream of the discharge roller 62 and the spur 63 in the sheet conveying direction 104. The contact member may be configured to contact the sheet 90 conveyed in the sheet conveying direction 104 and to restrict the sheet 90 from deviating from the conveying path 23. In this case, a printing process with such determination by the controller 70 may be stopped when the leading edge 91 has reached the contact member because a sheet jam is unlikely to occur once the leading edge 91 reaches the contact member.

In another embodiment, the controller 70 may determine whether the ink amount C exceeds the threshold value while resetting the ink amount C to zero each time the print head 39 makes a predetermined number of passes, and the controller 70 may make such determination from the start of printing until the trailing edge 92 of the sheet 90 is released from the nip portion between the covey roller 60 and the pinch roller 61.

Figure 9:
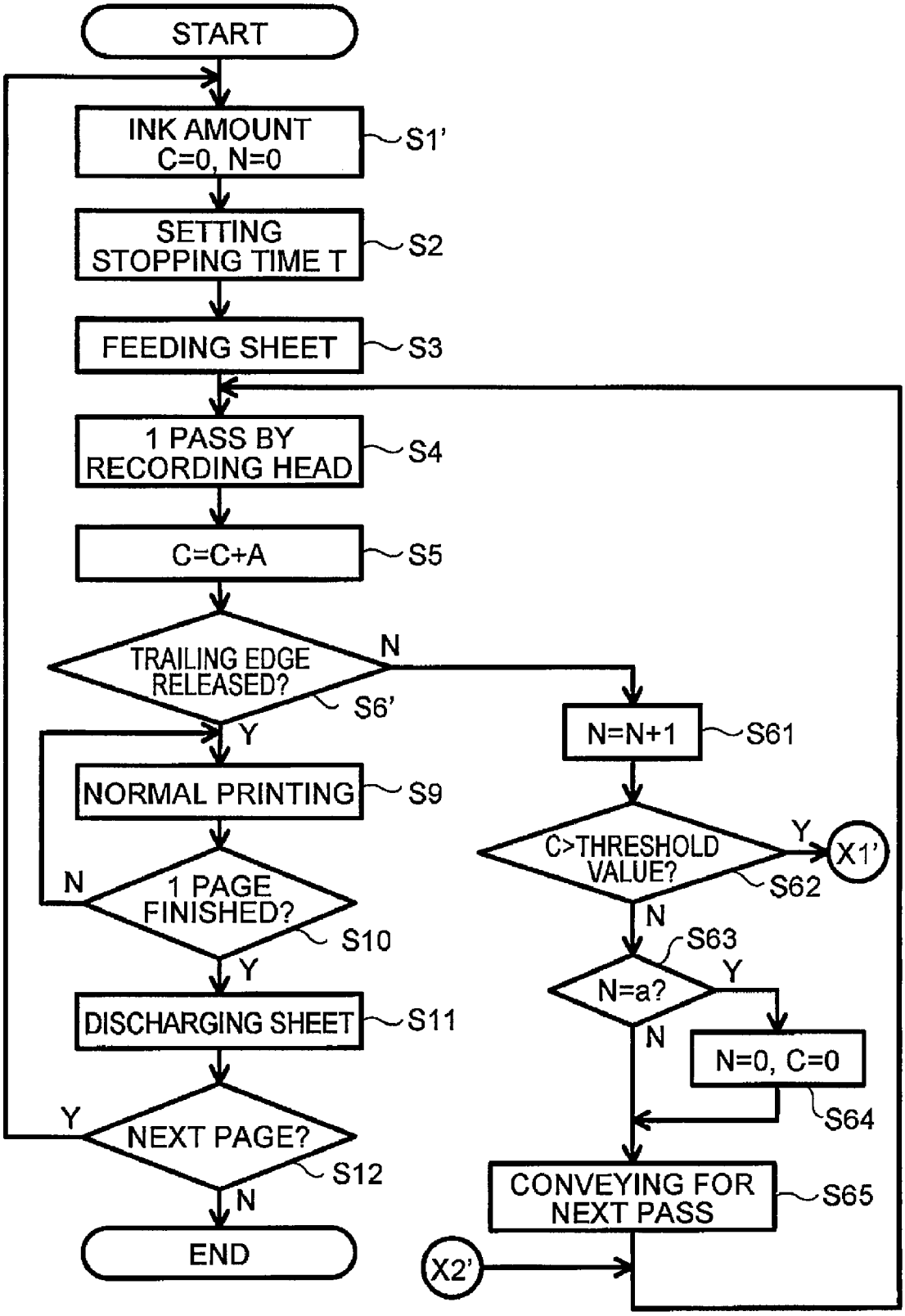
FIG. 9 is a flowchart illustrating an image recording method employed by a printer of the image recording device according to another embodiment of the invention.
Figure 10:
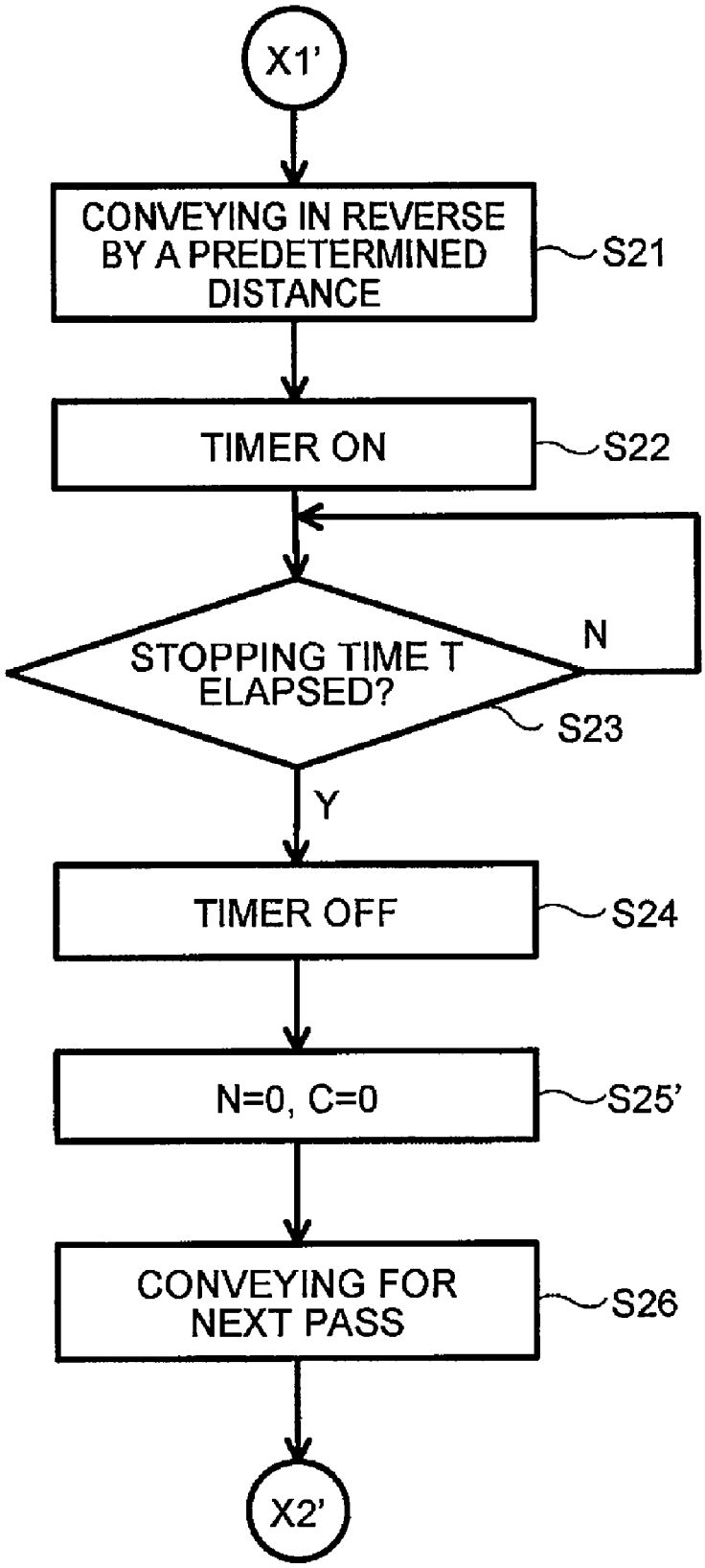
FIG. 10 a flowchart illustrating an image recording method employed by a printer of the image recording device according to the another embodiment of the invention.

As shown in FIGS. 9 and 10, when the user enters an instruction to start printing, the controller 70 may set the ink amount C to zero, and may set the number of passes N made by print head 39 to zero in step S1'. After updating the ink amount C by adding the amount of ink A ejected during the first pass in step S5, the controller 70 may determine whether the trailing edge 92 of the sheet 90 is released from the nip portion between the convey roller 60 and the pinch roller 61 in step S6'. If the controller 70 determines that the trailing edge 92 of the sheet 90 is not released from the nip portion between the convey roller 60 and the pinch roller 61 in step S6', the controller 70 may increment the number of passes N by 1 in step S61, and may determine whether the ink amount C exceeds the threshold value in step S62.

If the controller 70 determines that that the ink amount C does not exceed the threshold value in step S62, the controller may determine whether the number of passes N is equal to a predetermined value a in step S63. For example, when the ink amount C is reset to zero each time the recording head 39 makes three passes, the controller may determine whether the number of passes N is equal to 3 (N=3) in step S63. If the controller determines that the number of passes N is not equal to 3 in step S63, the controller 70 may rotate the convey roller 60 to feed the sheet 90 by a distance of the predetermined sheet feed amount F for image recording in the next pass in step S65. If the controller determines that the number of passes N is equal to 3, the controller may reset the ink amount C and the number of passes N to zero in step S64 and then feed the sheet 90 by the predetermined sheet feed amount F for image recording for the next pass in step S65.

If the controller 70 determines that the ink amount C exceeds the threshold value in step S62, the controller 70 may convey the sheet 90 in reverse by a predetermined distance and stops the sheet 90 by the stopping time T in steps S21 through S24. The controller 70 then may reset the amount of ink C and the number of passes N to zero, and may feed the sheet 90 by a distance of the predetermined sheet feed amount F plus the distance the sheet 90 was reversely conveyed for image recording for the next pass. Thus, deformation of the sheet may be restricted or corrected over a longer range.

Figure 14:
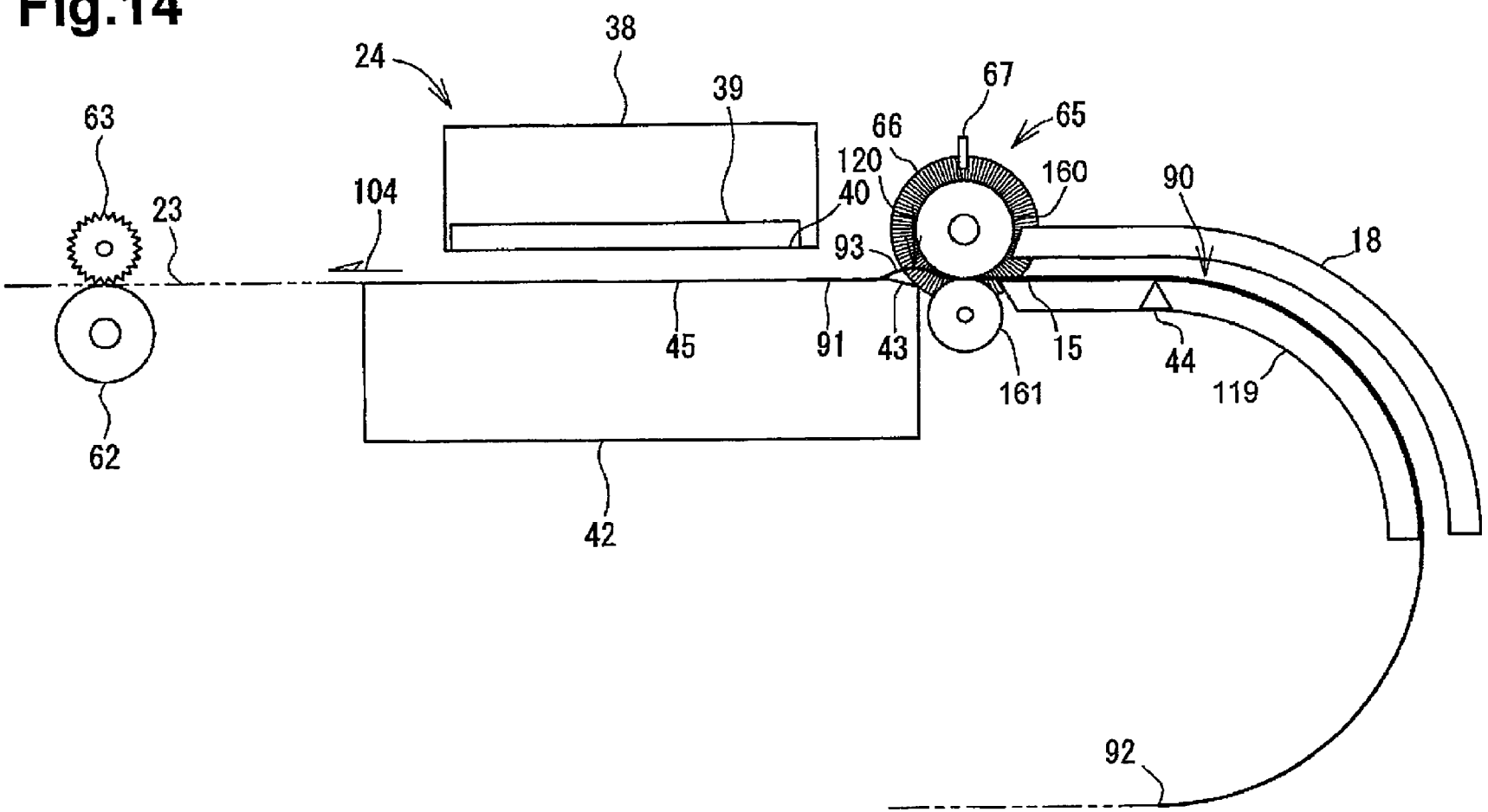
FIG. 14 is a schematic illustrating a printer in which a sheet is held in a predetermined shape according to another embodiment of the invention.

FIG. 14 illustrates a structure for holding the sheet 90 in the predetermined shape according to another embodiment of the invention. A nip portion between a convey roller 160 and a pinch roller 161 and a guide surface 15 of an inner guide member 119 may be flush with the upper surface 45 of the platen 42. The pinch roller 161 may be fixed at a predetermined position.

The controller 70 may rotate the convey roller 160 in reverse to convey the sheet 90 in reverse and stop rotating the convey roller 160 when the deformed portion 93, which protrudes upward, reaches a vicinity of the nip portion between the convey roller 160 and the pinch roller 161, as shown in FIG. 14. A leading edge 91 of the sheet 90 may be supported on the upper surface of the platen 42 when a trailing edge side of the portion 93 is pinched between the convey roller 160 and the pinch roller 161. A trailing edge side 92 of the sheet 90 exiting the nip portion may be supported on the guide surface 15 of the inner guide member 119. A leading edge side of the sheet 90 exiting the nip portion may bend downward. However, because the leading edge 91 is supported on the upper surface 45 of the platen 45 and the trailing edge side 92 of the sheet 90 exiting the nip portion is supported on the guide surface 15, the leading edge side of the sheet 90 may be prevented from bending downward by the upper surface 45 due to the rigidity of the sheet 90. Thus, the portion 93 of the sheet 90 may be bent to protrude downward. A downward force 120 may be applied to the portion 93 to restrict and/or correct the deformation of the portion 93.

Figure 15:
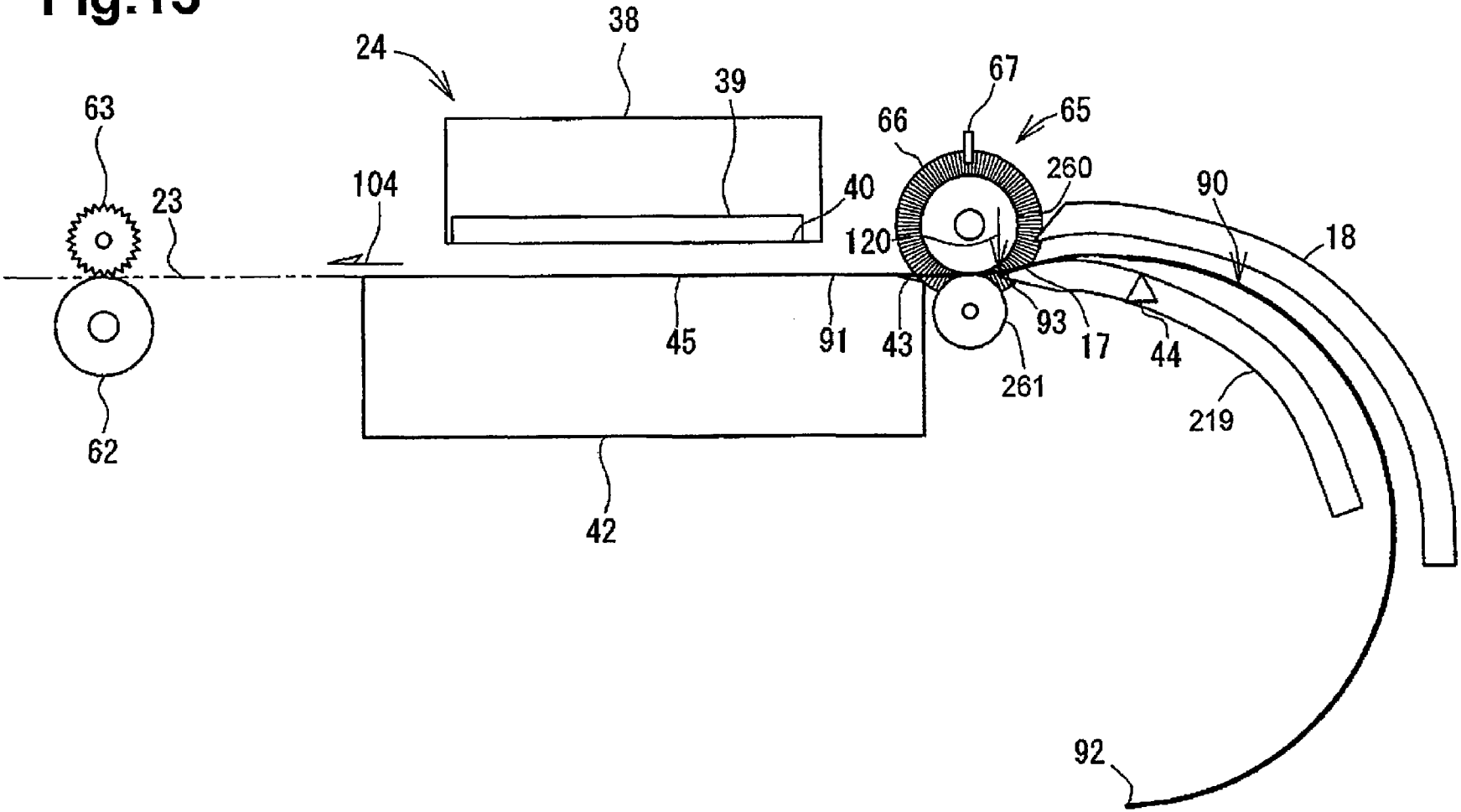
FIG. 15 is a schematic illustrating a printer in which a sheet is held in a predetermined shape according to still another embodiment of the invention.

In another embodiment, a guide surface 17 of an inner guide member 219 may protrude more upward than a nip portion between a convey roller 260 and a pinch roller 261, as shown in FIG. 15. The pinch roller 261 may be fixed at a predetermined position. The controller 70 may rotate the convey roller 260 in reverse to convey the sheet 90 in reverse, and may stop the convey roller 260 when the deformed portion 93, which protrudes upward, reaches the guide surface 17 of the inner guide member 219 after passing a nip portion between the convey roller 260 and the pinch roller 261. A portion of the sheet 90 at the leading edge side from the portion 93 may be pinched between the convey roller 260 and the pinch roller 261, and the portion 93 may be raised by the guide surface 17 higher than the nip portion. Thus, the portion 93 may be bent to protrude downward. A downward force 120 may be applied to the portion 93 to restrict or correct the deformation of the portion 93. The inner guide member 219 may be configured such that the angle of the guide surface thereof is changeable so as to apply the force 120 to the portion 93 when the sheet 90 is reversely conveyed and stopped.

Figure 16:
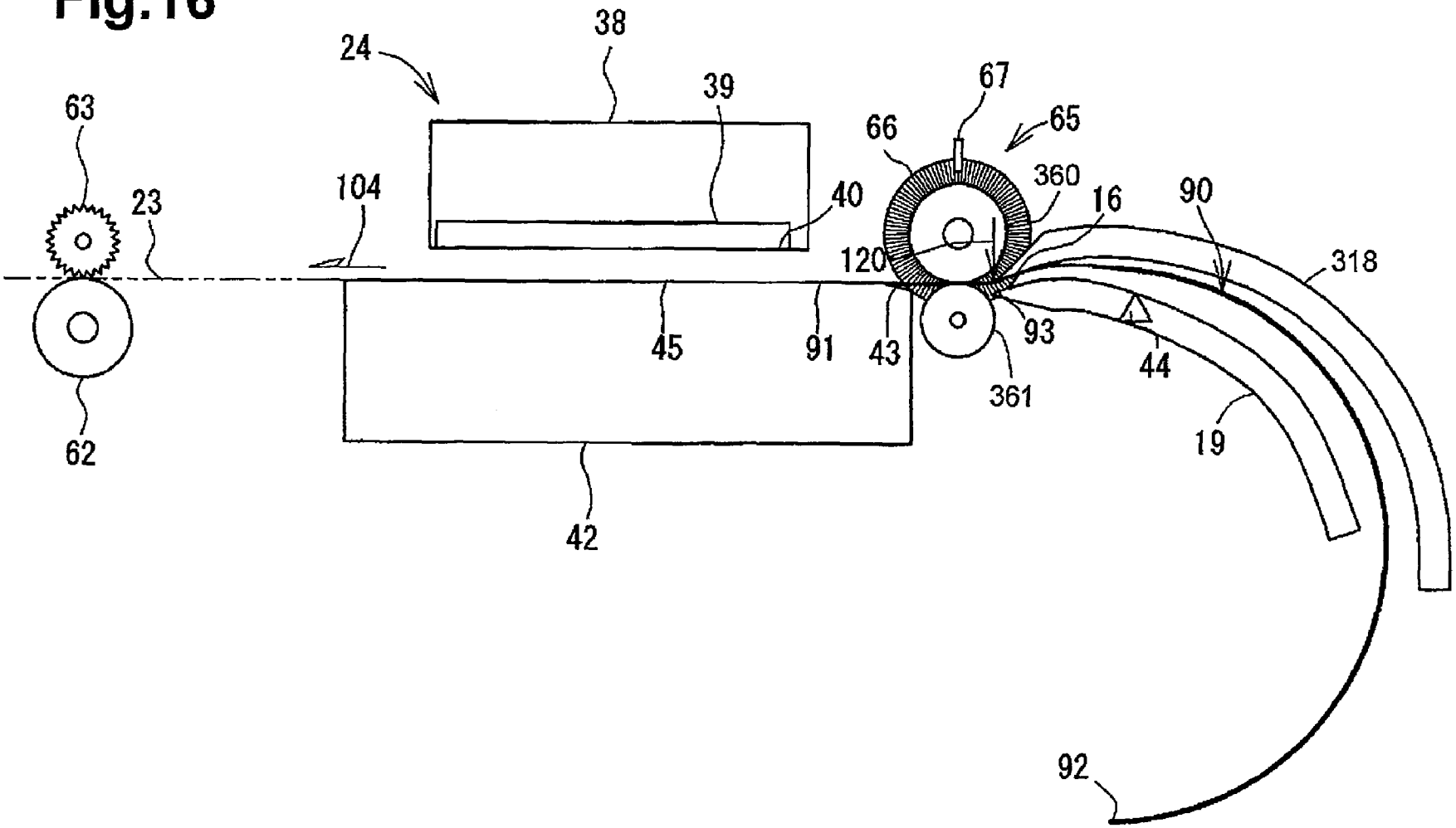
FIG. 16 is a schematic illustrating a printer in which a sheet is held in a predetermined shape according to yet another embodiment of the invention.

In yet another embodiment, a guide surface 16 of an outer guide member 318 may protrude downward with respect to a nip portion between a convey roller 360 and a pinch roller 361, as shown in FIG. 16. The pinch roller 361 may be fixed at a predetermined position. The controller 70 may rotate the convey roller 360 in reverse to convey the sheet 90 in reverse, and may stop rotating the convey roller 360 when a deformed portion 93, which protrudes upward, reaches the guide surface 16 of the outer guide member 218 after passing a nip portion between the convey roller 360 and the pinch roller 361. A leading edge end of the portion 93 may be pinched between the convey roller 360 and the pinch roller 361, and the portion 93 may be bent to protrude downward by the guide surface 16. A downward force 120 may be applied to the portion 93 to restrict and/or correct the deformation of the portion 93. The outer guide member 318 may be configured such that the angle of the guide surface thereof is changeable so as to apply the force 120 to the portion 93 when the sheet 90 is reversely conveyed and stopped.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. An image recording device comprising:

a recording unit configured to eject ink onto a sheet of recording medium;

a platen disposed opposite to the recording unit and configured to support the sheet;

a pair of upstream rollers disposed upstream of the recording unit and the platen in a sheet conveying direction and configured to convey the sheet in the sheet conveying direction when rotating in a forward direction; and a controller, wherein when the sheet is supported on the platen and pinched between the pair of upstream rollers, the controller is configured to control the recording unit to eject the ink onto a particular portion of the sheet, wherein the controller is further configured to determine whether a predetermined condition relating to ink ejection from the recording unit is satisfied by the ink ejection onto the particular portion, wherein when the controller determines that the predetermined condition is satisfied by the ink ejection onto the particular portion, the controller is configured to rotate the pair of upstream rollers in a reverse direction opposite the forward direction to convey the sheet in a direction opposite the sheet conveying direction, and is configured to subsequently stop rotating the pair of upstream rollers in the reverse direction, such that the pair of upstream rollers pinch the sheet for a particular amount of time, and wherein the upstream rollers are configured to hold the sheet in a predetermined shape for the particular amount of time to correct a deformation formed in the particular portion of the sheet by the ink ejected onto the particular portion of the sheet, and wherein when the controller determines that the predetermined condition is not satisfied by the ink ejection onto the particular portion, the controller is configured to rotate the pair of upstream rollers in the forward direction to convey the sheet in the sheet conveying direction, and is configured to cause the recording unit to eject ink onto a further portion of the sheet adjacent to the particular portion of the sheet.

2. The image recording device according to claim 1, wherein after the pair of upstream rollers are stopped for the particular amount of time, the controller is configured to rotate the pair of upstream rollers in the forward direction to convey the sheet in the sheet conveying direction and cause the recording unit to eject the ink onto a further portion of the sheet adjacent to the particular portion of the sheet.

3. The image recording device according to claim 1, wherein when the pair of upstream rollers are stopped for the particular amount of time, the pair of upstream rollers are configured to bow the portion of the sheet having received the ink to protrude outward away from the recording unit in a direction substantially parallel to a direction in which ink is ejected from the recording unit.

4. The image recording device according to claim 1, wherein the predetermined condition is satisfied when an ink amount ejected from the recording unit exceeds a threshold value.

5. The image recording device according to claim 1, wherein the predetermined condition is satisfied when a recording time taken by the recording unit exceeds a threshold value.

6. The image recording device according to claim 1, wherein the predetermined condition is satisfied when a number of passes made by the recording unit for ejecting the ink onto the sheet in a direction orthogonal to the sheet conveying direction exceeds a threshold value.

7. The image recording device according to claim 1, wherein the controller is configured to adjust the particular amount of time based on a device condition.

8. The image recording device according to claim 7, wherein the device condition is a temperature in the image recording device.

9. The image recording device according to claim 1, wherein the controller is configured to stop conveying the sheet in reverse when an upstream end of the particular portion of the sheet reaches a position located between the recording unit and a nip portion between the pair of upstream rollers.

10. The image recording device according to claim 1, wherein the controller is configured to stop conveying the sheet in reverse when an upstream end of the particular portion of the sheet reaches a position upstream of a nip portion between the pair of upstream rollers.

11. The image recording device according to claim 1, wherein when the pair of upstream rollers convey the sheet in the sheet conveying direction, the pair of upstream rollers are configured to position the sheet such that the sheet forms a first angle with respect to a sheet supporting surface of the platen, and the pair of upstream rollers are configured to press at least a portion of the sheet against the sheet supporting surface.

12. The image recording device according to claim 11, wherein when the pair of upstream rollers pinch the sheet during the particular amount of time, the pair of upstream rollers are configured to position and hold the sheet such that the sheet forms a second angle with respect to the sheet supporting surface, wherein the second angle is greater than the first angle.

13. The image recording device according to claim 1, further comprising a contact member disposed downstream of the recording unit and the platen in the sheet conveying direction and configured to contact the sheet conveyed in the sheet conveying direction, wherein the controller is configured to determine whether the predetermined condition is satisfied before a leading edge of the sheet reaches the contact member.

14. The image recording device according to claim 13, wherein the contact member comprises a pair of downstream rollers, wherein the controller is configured to determine whether the predetermined condition is satisfied before the leading edge of the sheet reaches the pair of downstream rollers.

15. An image recording device comprising:

a recording unit configured to eject ink onto a sheet of recording medium;

a platen disposed opposite to the recording unit and configured to support the sheet;

a pair of upstream rollers disposed upstream of the recording unit and the platen in a sheet conveying direction and configured to convey the sheet in the sheet conveying direction when rotating in a forward direction; and a controller, wherein when the sheet is supported on the platen and pinched between the pair of upstream rollers, the controller is configured to control the recording unit to eject the ink onto a particular portion of the sheet, and wherein the controller is configured to selectively rotate the pair of upstream rollers in a reverse direction opposite the forward direction to convey the sheet in a direction opposite the sheet conveying direction, and is configured to subsequently stop rotating the pair of upstream rollers in the reverse direction, such that the pair of upstream rollers pinch the sheet for a particular amount of time, and wherein the upstream rollers are configured to hold the sheet in a predetermined shape that restricts deformation of the particular portion of the sheet during the particular amount of time, wherein when the controller determines that a predetermined condition relating to ink ejection from the recording unit is satisfied, the controller is configured to rotate the pair of upstream rollers in the reverse direction to convey the sheet in the direction opposite the sheet conveying direction, wherein the predetermined condition is satisfied when an ink amount ejected from the recording unit exceeds a threshold value, and wherein the controller is configured to determine whether the ink amount ejected from the recording unit exceeds the threshold value each time the recording unit makes a pass over the sheet in a direction orthogonal to the sheet conveying direction.

16. The image recording device according to claim 15, wherein the controller is configured to initialize the ink amount to zero each time the sheet is stopped for the particular amount of time.

17. The image recording device according to claim 16, wherein the controller is configured to initialize the ink amount to zero each time the recording unit makes a predetermined number of passes.

18. A method for conveying a sheet of recording medium in an image recording device, the method comprising:

rotating a pair of upstream rollers in a forward direction to convey the sheet in a sheet conveying direction;

pinching the sheet between the pair of upstream rollers;

performing image recording by ejecting ink onto a particular portion of the sheet;

determining whether a predetermined condition relating to ink ejection from the recording unit is satisfied by the ink ejection onto the particular portion;

when the predetermined condition is determined to be satisfied, rotating the pair of upstream rollers in reverse to convey the sheet in a direction opposite the sheet conveying direction, stopping the reverse rotation of the pair of upstream rollers such that the pair of upstream rollers pinch the sheet between the pair of upstream rollers for a particular amount of time, and holding the sheet in a predetermined shape for the particular amount of time to correct a deformation formed in the particular portion of the sheet by the ink ejected onto the particular portion of the sheet with the pair of upstream rollers; and when the predetermined condition is determined not to be satisfied, rotating the pair of upstream rollers in the forward direction to convey the sheet in the sheet conveying direction, and performing image recording by ejecting ink onto a further portion of the sheet adjacent to the particular portion of the sheet.

19. The method of conveying the sheet according to claim 18, further comprising the step of bending the portion of the sheet to protrude away from the recording unit when the pair of upstream rollers are holding the sheet in the predetermined shape.

* * * * *